US011724526B2

(12) United States Patent
Minemura et al.

(10) Patent No.: US 11,724,526 B2
(45) Date of Patent: Aug. 15, 2023

(54) RECORDING DEVICE

(71) Applicant: SEIKO EPSON CORPORATION, Tokyo (JP)

(72) Inventors: Hidefumi Minemura, Shiojiri (JP); Katsumi Yamada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 6 days.

(21) Appl. No.: 17/445,877

(22) Filed: Aug. 25, 2021

(65) Prior Publication Data

US 2022/0063310 A1 Mar. 3, 2022

(30) Foreign Application Priority Data

Aug. 28, 2020 (JP) ..... 2020-144254

(51) Int. Cl.

| | |
|---|---|
| ***B41J 13/00*** | (2006.01) |
| ***B41J 13/10*** | (2006.01) |
| ***B41J 29/38*** | (2006.01) |
| ***B41J 13/02*** | (2006.01) |
| ***B65H 31/02*** | (2006.01) |

(52) U.S. Cl.

CPC ..... *B41J 13/0036* (2013.01); *B41J 13/02* (2013.01); *B41J 13/106* (2013.01); *B41J 29/38* (2013.01); *B65H 31/02* (2013.01); *B65H 2403/40* (2013.01)

(58) Field of Classification Search

CPC ..... B41J 13/0036; B41J 13/02; B41J 13/106

See application file for complete search history.

(56) References Cited

U.S. PATENT DOCUMENTS

| | | | | |
|---|---|---|---|---|
| 6,435,745 | B1 | 8/2002 | Yamada | |
| 2018/0029393 | A1* | 2/2018 | Matsumoto | B41J 25/006 |

FOREIGN PATENT DOCUMENTS

| | | | |
|---|---|---|---|
| JP | 2001-072309 | A | 3/2001 |
| JP | 2018-016480 | A | 2/2018 |

* cited by examiner

*Primary Examiner* — Jason S Uhlenhake

(74) *Attorney, Agent, or Firm* — Workman Nydegger

(57) ABSTRACT

A recording device includes a recording unit, a discharge roller unit, a medium receiving tray, a motor serving as a power source of the discharge roller, a power transmission unit that is configured to switch between a power transmission state in which power of the motor is transmitted from the motor to the medium receiving tray, and a power non-transmission state in which the power of the motor is not transmitted from the motor to the medium receiving tray, and a restriction unit that is configured to switch between a restriction state in which the restriction unit restricts displacement of the medium receiving tray when the power transmission unit is in the power non-transmission state, and a non-restriction state in which the restriction unit does not restrict the displacement of the medium receiving tray when the power transmission unit is in the power transmission state.

10 Claims, 15 Drawing Sheets

RECORDING DEVICE

The present application is based on, and claims priority from JP Application Serial Number 2020-144254, filed Aug. 28, 2020, the disclosure of which is hereby incorporated by reference herein in its entirety.

BACKGROUND

1. Technical Field

The present disclosure relates to a recording device that performs recording on a medium.

2. Related Art

A recording device typified by a facsimile, a printer, and the like includes a medium receiving tray that receives a medium subjected to recording and discharged. Further, such a medium receiving tray is configured so as to be able to switch between a housed state and a developed state by a motor as indicated in JP-A-2018-16480. In the recording device described in JP-A-2018-16480, power is transmitted from a discharge roller to a discharge tray serving as a medium receiving tray, and the discharge tray is displaced.

In the configuration described in JP-A-2018-16480, a toothed gear for transmitting power is provided on the discharge roller, and the toothed gear is referred to as a trigger output gear. The trigger output gear is provided so as to be movable in a shaft line direction of the discharge roller by movement of a carriage, and can be displaced into a position in which the trigger output gear meshes with a toothed gear referred to as an input gear by movement of the carriage, and a position in which the trigger output gear does not mesh with the input gear. Then, the discharge roller rotates in a state where the trigger output gear and the input gear mesh with each other, and thus power is transmitted from the discharge roller to the discharge tray, and the discharge tray is displaced.

In a configuration in which a medium receiving tray is driven by a motor, and particularly, a configuration in which power is transmitted from a motor for driving another configuration to a medium receiving tray, such as the recording device described in JP-A-2018-16480, there is room for further improvement in the following points.

First, in a case of a power non-transmission state where power is not transmitted from a motor to a medium receiving tray, since the medium receiving tray can freely move, there is a risk that the medium receiving tray unintentionally moves when a device is tilted and the like, and a configuration in consideration of this point is desired. Secondly, in a case of a power transmission state where power is transmitted from the motor to the medium receiving tray, it is preferable to suppress a load applied to the motor as much as possible in terms of suppression of power consumption and the like.

SUMMARY

A recording device according to the present disclosure that solves the above-described problem includes a recording unit that is configured to perform recording on a medium, a discharge roller that is configured to discharge the medium on which recording was performed by the recording unit, a medium receiving tray that is configured to receive the medium discharged by the discharge roller, and switch between a first state and a second state in which the medium receiving tray is displaced in a discharge direction of the medium with respect to the first state, a motor that serves as a power source of the discharge roller, a power transmission unit that is configured to switch between a power transmission state in which power of the motor is transmitted from the motor to the medium receiving tray, and a power non-transmission state in which the power of the motor is not transmitted from the motor to the medium receiving tray, and a restriction unit that is configured to switch between a restriction state in which the restriction unit restricts displacement of the medium receiving tray when the power transmission unit is in the power non-transmission state, and a non-restriction state in which the restriction unit does not restrict the displacement of the medium receiving tray when the power transmission unit is in the power transmission state.

DESCRIPTION OF EXEMPLARY EMBODIMENTS

Figure 1:
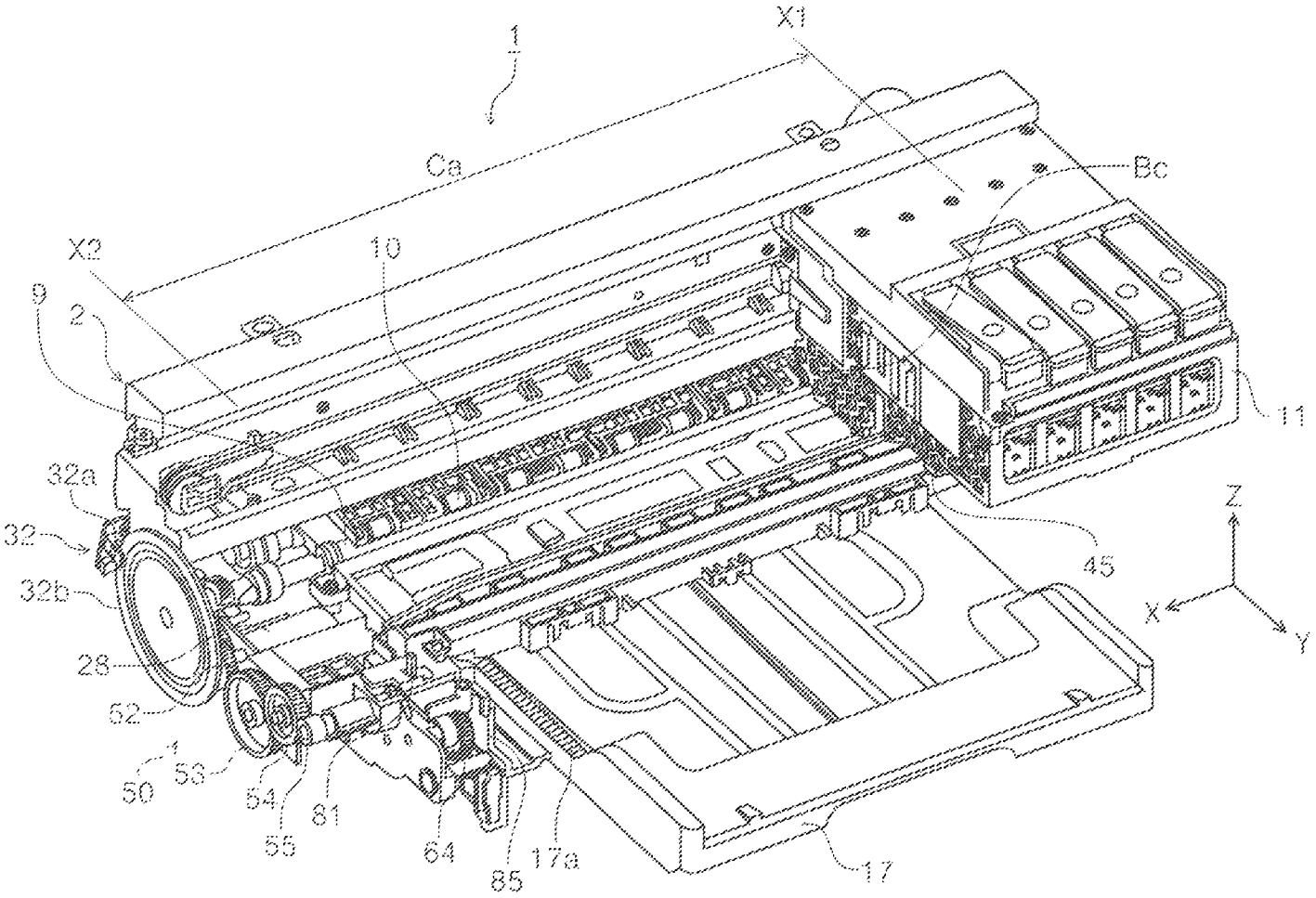
FIG. 1 is a perspective view of a device main body of a printer.

Hereinafter, the present disclosure will be schematically described.

A recording device according to a first aspect includes a recording unit that is configured to perform recording on a medium, a discharge roller that is configured to discharge the medium on which recording was performed by the recording unit, a medium receiving tray that is configured to receive the medium discharged by the discharge roller and switch between a first state and a second state in which the medium receiving tray is displaced in a discharge direction of the medium with respect to the first state, a motor that serves as a power source of the discharge roller, a power transmission unit for switching between a power transmission state in which power of the motor is transmitted from the motor to the medium receiving tray, and a power non-transmission state in which the power of the motor is not transmitted from the motor to the medium receiving tray, and a restriction unit that is configured to switch between a restriction state in which the restriction unit restricts displacement of the medium receiving tray when the power transmission unit is in the power non-transmission state, and a non-restriction state in which the restriction unit does not restrict the displacement of the medium receiving tray when the power transmission unit is in the power transmission state.

In a configuration in which the medium receiving tray is driven by the motor serving as the power source of the discharge roller, the present aspect provides the restriction unit for switching between the restriction state of restricting displacement of the medium receiving tray when the power transmission unit is in the power non-transmission state, and the non-restriction state of not performing the restriction when the power transmission unit is in the power transmission state. Thus, displacement of the medium receiving tray is restricted in the power non-transmission state, and a malfunction that the medium receiving tray unintentionally moves when the device is tilted and the like can be suppressed.

Then, in the power transmission state, the restriction unit is in the non-restriction state of not restricting displacement of the medium receiving tray. Thus, the restriction unit does not apply a load to the motor, or the load can be reduced even when the restriction unit applies the load.

In a second aspect, in the first aspect, the power transmission unit includes a first power transmission path coupled to the motor, and a second power transmission path that is provided downstream of the first power transmission path in a transmission direction of power from the motor to the medium receiving tray, the first power transmission path is coupled to the second power transmission path, when the power transmission unit is in the power transmission state, and the first power transmission path is uncoupled from the second power transmission path when the power transmission unit is in the power non-transmission state, the restriction unit includes an movable member that is configured to be displaced into a contact position in which the movable member is in contact with a rotating body that is provided on the second power transmission path, and a separation position in which the movable member is separated from the rotating body, and the movable member is located in the contact position when the restriction unit is in the restriction state, and the movable member located in the separation position when the restriction unit is in the non-restriction state.

According to the present aspect, the restriction unit is configured to switch between the restriction state and the non-restriction state by displacement of the movable member, and thus the restriction unit can be formed with a simple structure.

In a third aspect, in the second aspect, the rotating body is formed of a first toothed gear, a second toothed gear is provided on the first power transmission path, the second toothed gear is configured to be displaced into a meshing position in which the second toothed gear meshes with the first toothed gear to couple the first power transmission path and the second power transmission path, and a non-meshing position in which the second toothed gear is separated from the first toothed gear to be uncoupled from the first power transmission path and the second power transmission path, and the movable member is provided so as to advance and retreat with respect to the first toothed gear in conjunction with displacement of the second toothed gear, and, the movable member is located in the separation position when the second toothed gear is located in the meshing position, and the movable member is located in the contact position when the second toothed gear is located in the non-meshing position.

According to the present aspect, the movable member is provided, by engaging with the second toothed gear, so as to advance and retreat with respect to the first toothed gear in conjunction with displacement of the second toothed gear. Thus, a special power source for displacing the movable member is unnecessary, and a cost of the device can be suppressed.

In a fourth aspect, in the third aspect, the movable member includes a tooth portion that is configured to mesh with the first toothed gear in the contact position.

According to the present aspect, the movable member includes the tooth portion that is configured to mesh with the first toothed gear, and the restriction unit is brought into the restriction state by the first toothed gear and the tooth portion meshing with each other when the movable member is located in the contact position. Thus, displacement of the medium receiving tray can be reliably restricted.

In a fifth aspect, in the third or fourth aspect, a carriage that is provided with the recording unit and configured to move along a movement axis intersecting a transport direction in which the medium is transported is provided, the power transmission unit includes a lever member configured to be displaced along a direction along the movement axis, and switch, by rotation of the motor, between an advance state in which the lever advances into a movement region of the carriage and a retraction state in which the lever retracts from the movement region of the carriage, and the second toothed gear and the movable member are displaced when the lever member is displaced in the direction.

According to the present aspect, in a configuration in which the carriage pushes the lever member to displace the second toothed gear and the movable member, the lever member is provided in a position adjacent to the second toothed gear. The second toothed gear is subjected to external force from the carriage via the lever member in a position close to the carriage, and the second toothed gear can be favorably displaced in response.

In a sixth aspect, in the fifth aspect, the second toothed gear and the lever member are provided on a shaft member that is a different member from a rotary shaft of the discharge roller, and are provided so as to be slidable with respect to the shaft member.

According to the present aspect, the second toothed gear and the lever member are provided so as to be slidable with respect to the shaft member that is the different member from the rotary shaft of the discharge roller. Thus, a degree of freedom of arrangement of the second toothed gear and the lever member is improved.

In a seventh aspect, in the fifth or sixth aspect, one direction along the movement axis of the carriage is a first direction, and the other direction along the movement axis of the carriage is a second direction, the second toothed gear, the lever member, and the movable member are pressed toward the second direction, and the carriage pushes, in the first direction, the lever member, the second toothed gear is displaced from the non-meshing position to the meshing position and the movable member is displaces from the contact position to the separation position.

In an eighth aspect, in the seventh aspect, a control unit that is configured to control a drive source of the carriage and the motor is further provided, and, in a case in which the carriage pushes, in the first direction, the lever member, the second toothed gear is displaced from the non-meshing position toward the meshing position and a drive load of the carriage exceeds a threshold value, the control unit stops the carriage, rotates the motor by a predetermined amount, and then moves the carriage again in the first direction.

When the carriage pushes, in the first direction, the lever member in the advance state to displace the second toothed gear from the non-meshing position to the meshing position, a tooth of the second toothed gear and a tooth of the first toothed gear may collide with each other, and the first toothed gear and the second toothed gear may not mesh with each other. In such a case, a drive load of the carriage exceeds a threshold value, but at this time, the control unit stops the carriage, rotates the motor by a predetermined amount, and then moves the carriage again in the first direction. Thus, the first toothed gear and the second toothed gear can be expected to appropriately mesh with each other.

In a ninth aspect, in the seventh or eighth aspect, the carriage includes a lever contact portion that is configured to come into contact with the lever member, and the lever contact portion includes a wall that is configured to maintain a state where the lever member is in contact with the lever contact portion.

According to the present aspect, the state where the lever member is in contact with the lever contact portion is maintained regardless of a rotation direction of the motor. Thus, when the power transmission unit is in the power transmission state, the medium receiving tray can be freely driven in a direction from the first state toward the second state and a reverse direction thereof.

In a tenth aspect, in any of the seventh to ninth aspects, the power transmission unit includes a first pressing member that is configured to press the second toothed gear toward the non-meshing position, and the restriction unit includes a second pressing member configured to press the movable member toward the contact position.

Both of pressing force for pressing the second toothed gear and pressing force for pressing the movable member can be set to appropriate magnitude.

In an eleventh aspect, in any of the seventh to tenth aspects, a stopper that is configured to restrict displacement, in the second direction, of the lever member in the retraction state when the second toothed gear is located in the meshing position and the movable member is located in the separation position is provided.

The present aspect provides the stopper that is configured to stop displacement, in the second direction, of the lever member in the retraction state when the second toothed gear is located in the meshing position and the movable member is also located in the separation position. Thus, even when the carriage is separated from the lever member, the second toothed gear can be prevented from returning to the non-meshing position and the movable member can be prevented from returning to contact position. In other words, even when the carriage is separated from the lever member, the power transmission unit can maintain the power transmission state. Thus, a degree of freedom of control of the carriage is improved.

Hereinafter, the present disclosure will be described.

Hereinafter, an ink jet printer 1 will be described as an example of a recording device. Hereinafter, the inkjet printer 1 is simply referred to as a printer 1.

Note that, in an X-Y-Z coordinate system illustrated in each drawing, an X-axis direction is a movement direction of a carriage 11, an −X direction is a first direction, and an +X direction is a second direction. A home position of the carriage 11 is set to an end portion in the −X direction. Further, the X-axis direction is a width direction of a recording sheet on which recording was performed, and is a width direction of the device.

A Y-axis direction is a depth direction of the device, is a direction along a sheet transport direction during recording, and is a displacement direction of a sheet receiving tray 17 described later. A +Y direction is a direction from a rear surface of the device toward a front surface, and a −Y direction is a direction from the front surface of the device toward the rear surface.

A Z-axis direction is a direction along a vertical direction, and is a height direction of the device. A +Z direction is a vertically upward direction, and a −Z direction is a vertically downward direction.

In FIG. 1, the printer 1 includes a device main body 2 that performs inkjet recording on a recording sheet as an example of a medium. FIG. 1 illustrates a state where a housing (not illustrated) that covers the device main body 2 is removed. The carriage 11 including a recording head 12 (see FIG. 2) is provided on the device main body 2 so as to be movable in the X-axis direction. A range indicated by a reference sign Ca in FIG. 1 is a movement range of the carriage 11, and indicates a movement range of the carriage 11 with reference to a central position of the carriage 11 in the X-axis direction. A reference sign X1 is a position of the carriage 11 located farthest in the −X direction in the movement range Ca, and a reference sign X2 is a position located farthest in the +X direction in the movement range Ca. Further, in FIG. 1, a reference sign Bc indicates a movement region of the carriage 11.

The device main body 2 is provided with the sheet receiving tray 17 as a medium receiving tray for receiving a recording sheet subjected to recording and discharged in the +Y direction. The sheet receiving tray 17 is provided so as to receive power from a transport motor 28 and be displaced along the Y-axis direction.

The transport motor 28 and a power transmission unit 50 for transmitting power from the transport motor 28 to the sheet receiving tray 17 are provided in the +X direction with respect to the sheet receiving tray 17. The sheet receiving tray 17 and the power transmission unit 50 will be described later in detail.

Figure 2:
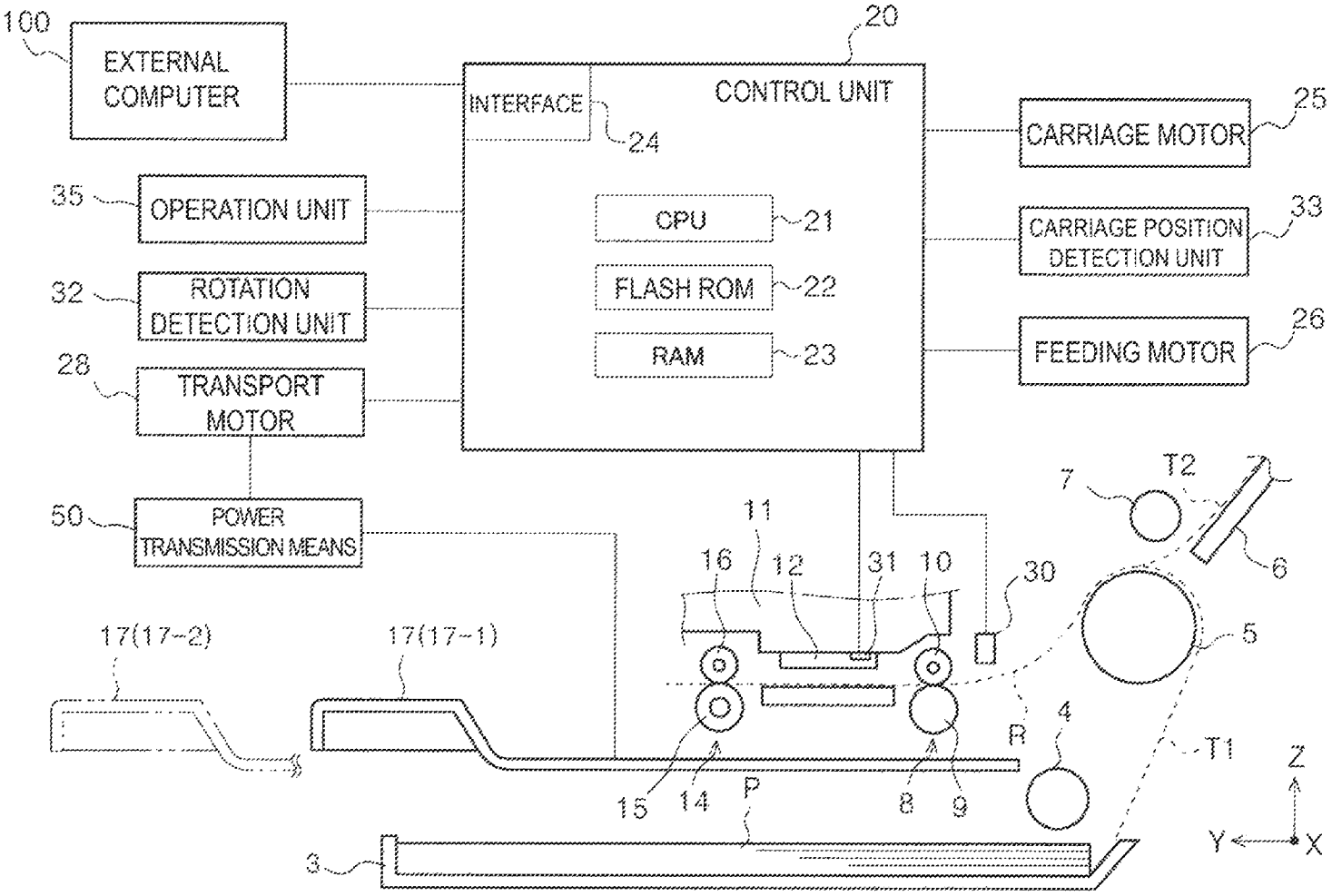
FIG. 2 is a diagram illustrating a sheet transport path and a control system of the printer.

Next, a sheet transport path and a control system of the printer 1 will be described with reference to mainly FIG. 2. The printer 1 includes a first sheet feeding path T1 for feeding a recording sheet from a paper feed cassette 3 at the bottom of the device, and a second sheet feeding path T2 for feeding a recording sheet from an inclined support portion 6 at the rear of the device.

On the first sheet feeding path T1, a recording sheet accommodated in the paper feed cassette 3 is fed downstream by a first feeding roller 4. The first feeding roller 4 is provided so as to be able to advance and retreat with respect to the paper feed cassette 3, and also rotates by receiving power from a feeding motor 26. In FIG. 2, a reference sign P indicates a recording sheet accommodated in the paper feed cassette 3.

The recording sheet fed from the paper feed cassette 3 by the first feeding roller 4 reaches an inversion roller 5 located above the first feeding roller 4. The inversion roller 5 rotates by receiving power from the feeding motor 26. The recording sheet fed from the paper feed cassette 3 is curved and inverted by the inversion roller 5, and is directed in the +Y direction.

On the second sheet feeding path T2, the recording sheet supported by the inclined support portion 6 is fed downstream by a second feeding roller 7. The second feeding roller 7 rotates by receiving power from the feeding motor 26. The inclined support portion 6 presses the supported recording sheet against the second feeding roller 7 by rocking about a swing shaft (not illustrated).

The recording sheet fed from the paper feed cassette 3 by the second feeding roller 7 reaches the inversion roller 5, and is directed in the +Y direction toward the inversion roller 5.

A transport roller pair 8 located downstream of the inversion roller 5 is configured to include a transport driving roller 9 and a transport driven roller 10. The transport driving roller 9 rotates by receiving power from the transport motor 28. The transport driven roller 10 is driven by rotation while being in contact with the transport driving roller 9 or the recording sheet to be transported.

Figure 3:
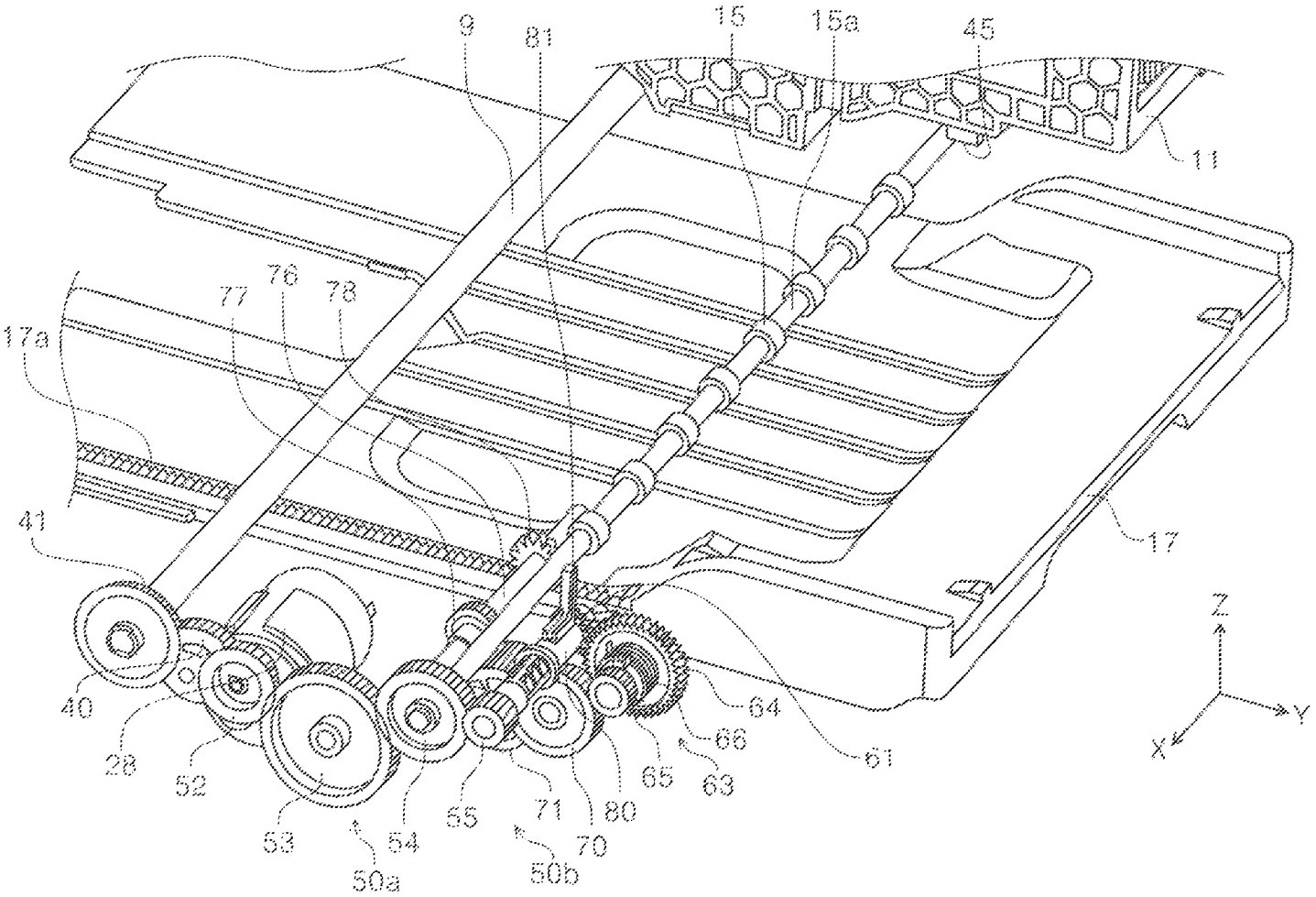
FIG. 3 is a perspective view of a sheet receiving tray and a power transmission unit.

As illustrated in FIGS. 1 and 3, the transport driving roller 9 is formed of a shaft body extending in the X-axis direction, and, as illustrated in FIG. 1, a plurality of the transport driven rollers 10 are disposed at an interval along the X-axis direction.

The recording head 12 as an example of a recording unit is provided downstream of the transport roller pair 8. The recording head 12 is formed as an ink jet-type recording head that performs recording while moving in the X-axis direction in the present exemplary embodiment. The carriage 11 provided with the recording head 12 acquires power from a carriage motor 25 being a drive source, and moves in the X-axis direction.

A discharge roller pair 14 is provided downstream of the recording head 12. The discharge roller pair 14 is configured to include a discharge driving roller 15 and a discharge driven roller 16. The discharge driving roller 15 rotates by receiving power from the transport motor 28. The discharge driven roller 16 is driven by rotation while being in contact with the discharge driving roller 15 or the recording sheet to be transported. The recording sheet on which recording was performed is discharged toward the sheet receiving tray 17 by the discharge roller pair 14.

Note that, as illustrated in FIG. 3, a plurality of the discharge driving rollers 15 are disposed at an interval along the X-axis direction with respect to a rotary shaft 15*a* extending along the X-axis direction. Although not illustrated, a plurality of the discharge driven rollers 16 are disposed at an interval along the X-axis direction so as to correspond to the plurality of discharge driving rollers 15.

Returning to FIG. 2, the sheet receiving tray 17 can switch between a first state and a second state of being displaced in the +Y direction, i.e., a sheet discharge direction with respect to the first state by receiving power from the transport motor 28. In FIG. 2, the sheet receiving tray 17 indicated by a reference sign 17-1 and a solid line is in the first state, and the sheet receiving tray 17 indicated by a reference sign 17-2 and a two-dot chain line is in the second state.

Next, a control system in the printer 1 will be described.

Information is input from an operation unit 35 or an external computer 100 into a control unit 20 included in the printer 1. The control unit 20 performs various types of control on the printer 1 based on the information received from the operation unit 35 or the external computer 100.

The control unit 20 controls motors of the carriage motor 25, the feeding motor 26, and the transport motor 28. In the present exemplary embodiment, each of the motors is a DC motor.

A detection signal from detection units of a first sheet detection unit 30, a second sheet detection unit 31, a rotation detection unit 32, and a carriage position detection unit 33 is also input into the control unit 20.

The control unit 20 includes a CPU 21, a flash ROM 22, and a RAM 23. The CPU 21 performs various types of arithmetic processing according to a program stored in the flash ROM 22 to control an operation of the entire printer 1. A program for controlling each of the motors is also stored in the flash ROM 22. The flash ROM 22 is a non-volatile memory that can perform reading and writing. Various pieces of information are temporarily stored in the RAM 23.

Further, the control unit 20 includes an interface 24, and can communicate with the external computer 100 via the interface 24.

Next, each of the detection units will be described.

The carriage position detection unit 33 is a linear encoder, and is a detection unit for detecting a position of the carriage 11 in the X-axis direction. The carriage position detection unit 33 is configured to include a linear scale (not illustrated) provided along the X-axis direction, and a detection unit (not illustrated) that is provided on the carriage 11 and detects the linear scale.

The rotation detection unit 32 is a rotary encoder, and is a detection unit for detecting the amount of rotation and a rotational speed of a component driven by the transport motor 28. As illustrated in FIG. 1, the rotation detection unit 32 is configured to include a rotary scale 32*b* provided at a shaft end of the transport driving roller 9 in the +X direction, and a detection unit 32*a* that detects the rotary scale 32*b*.

Returning to FIG. 2, the first sheet detection unit 30 is provided near the upstream side of the transport roller pair 8, and detects passage of a leading end and a rear end of the recording sheet. The first sheet detection unit 30 is formed of a non-contact optical sensor. The control unit 20 can determine a position of the recording sheet based on detection information of the first sheet detection unit 30.

The second sheet detection unit 31 is an optical sensor provided in a position on a bottom surface of the carriage 11 facing the recording sheet, and is configured to include a light-emitting unit (not illustrated) that emits detection light toward the recording sheet, and a light-receiving unit (not illustrated) that receives reflected light from the recording sheet. The control unit 20 operates the carriage 11 in a state where the recording sheet is present in a position facing the second sheet detection unit 31, and can detect an edge position in the width direction of the recording sheet based on a change in the detection signal of the second sheet detection unit 31 at the time. Further, in a state where the carriage 11 is located in a printing region, passage of the leading end and the rear end of the recording sheet can also be detected based on a change in the detection signal of the second sheet detection unit 31.

Next, the power transmission unit 50 for transmitting power from the transport motor 28 to the sheet receiving tray 17 will be described.

In FIG. 3, the power transmission unit 50 transmits power from the transport motor 28 to the sheet receiving tray 17. The power transmission unit 50 includes a first power transmission path 50*a*, and a second power transmission path 50*b* provided downstream of the first power transmission path 50*a* in a power transmission direction from the transport motor 28 to the sheet receiving tray 17. Note that, hereinafter, the power transmission direction from the transport motor 28 to the sheet receiving tray 17 is simply referred to as a "power transmission direction". Further, hereinafter, a direction along the power transmission direction is referred to as "downstream".

The first power transmission path 50*a* includes, in an order toward the downstream side in the power transmission direction, a toothed gear 52, a toothed gear 53, a toothed gear 54, a toothed gear 55, a transmission shaft 60, and a second toothed gear 61. The toothed gear 52 meshes with the toothed gear 53, the toothed gear 53 meshes with the toothed gear 54, and the toothed gear 54 meshes with the toothed gear 55. The toothed gear 55 transmits power to the second toothed gear 61 via the transmission shaft 60.

The second power transmission path 50*b* includes, in an order toward the downstream side in the power transmission direction, a first toothed gear 64, a toothed gear 65, a toothed gear 70, a toothed gear 71, a toothed gear 77, a tray drive shaft 76, and a pinion toothed gear 78. The first toothed gear 64 is an example of a rotating body. A frictional clutch 63 is provided between the first toothed gear 64 and the toothed gear 65, and the first toothed gear 64 transmits power to the toothed gear 65 via a frictional force. A reference sign 66 indicates a coil spring constituting the frictional clutch 63, and a frictional force is generated between the first toothed gear 64 and the toothed gear 65 due to contact between the first toothed gear 64 and the toothed gear 65 by a pressing force of the coil spring 66. By the frictional force, power is transmitted from the first toothed gear 64 to the toothed gear 65. Therefore, for example, in a case in which the sheet receiving tray 17 comes into contact with some obstacle when the sheet receiving tray 17 protrudes in the +Y direction, the first toothed gear 64 and the toothed gear 65 can idle.

Further, there is a case in which a restriction unit 82 described later restricts rotation of the first toothed gear 64, but, even in this case, the first toothed gear 64 and the toothed gear 65 can relatively rotate, and thus a user can manually move the sheet receiving tray 17 along the Y-axis direction.

The toothed gear 65 meshes with the toothed gear 70, the toothed gear 70 meshes with the toothed gear 71, and the toothed gear 71 meshes with the toothed gear 77. The toothed gear 77 is fixed to the tray drive shaft 76, and transmits power to the pinion toothed gear 78 via the tray drive shaft 76.

The pinion toothed gear 78 is fixed to the tray drive shaft 76, and also meshes with a rack portion 17*a* formed in the sheet receiving tray 17 along the Y-axis direction, to constitute a rack pinion mechanism.

Note that all rotating members constituting the power transmission unit 50, specifically, toothed gears and shafts, are supported by a frame 85 (see FIG. 1) or another frame (not illustrated) such that a shaft center line thereof is parallel to the X axis.

In the present exemplary embodiment, as described above, the power transmission unit 50 is configured to transmit power of the transport motor 28 to the sheet receiving tray 17 by meshing of the toothed gears, but a portion that transmits power by belt driving can also be adopted to a part of the power transmission unit 50.

According to the configuration described above, power of the transport motor 28 is transmitted to the sheet receiving tray 17, and the sheet receiving tray 17 is displaced in the +Y direction or the −Y direction in accordance with a rotation direction of the transport motor 28. Note that the transport motor 28 transmits power to a toothed gear 41 provided on an end portion of the transport driving roller 9 in the +X direction via a toothed gear 40, and rotates the transport driving roller 9. Further, the toothed gear 54 constituting the first power transmission path 50*a* is provided on an end portion in the +X direction of the rotary shaft 15*a* provided with the discharge driving roller 15, and thus the transport motor 28 rotates the discharge driving roller 15.

When the transport motor 28 rotates in a normal direction, the transport driving roller 9 and the discharge driving roller 15 rotate in a direction in which the recording sheet is fed downstream, i.e., in the normal direction. Further, when the transport motor 28 rotates in a reverse direction, the transport driving roller 9 and the discharge driving roller 15 rotate in a direction in which the recording sheet returns upstream, i.e., in the reverse direction.

Further, in a power transmission state where the power transmission unit 50 transmits power from the transport motor 28 to the sheet receiving tray 17, when the transport motor 28 rotates in the normal direction, the sheet receiving tray 17 is displaced in the +Y direction, and when the transport motor 28 rotates in the reverse direction, the sheet receiving tray 17 is displaced in the −Y direction.

The power transmission unit 50 described above is configured to be able to switch between the power transmission state of transmitting power from the transport motor 28 to the sheet receiving tray 17 and a power non-transmission state of not transmitting power from the transport motor 28 to the sheet receiving tray 17. Hereinafter, a configuration for performing the switching will be described.

Figure 4:
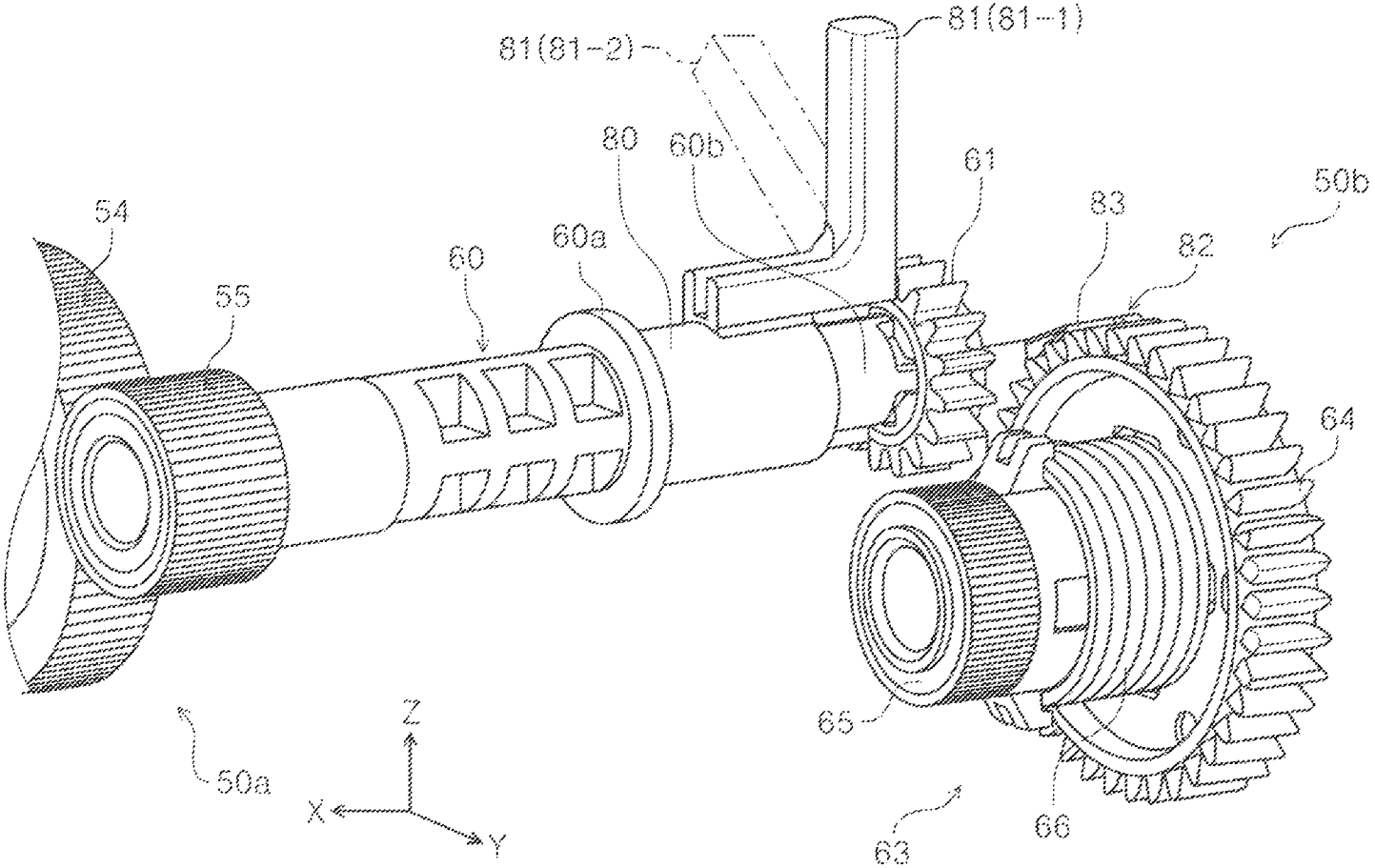
FIG. 4 is a perspective view of a main portion of the power transmission unit in a power non-transmission state.
Figure 5:
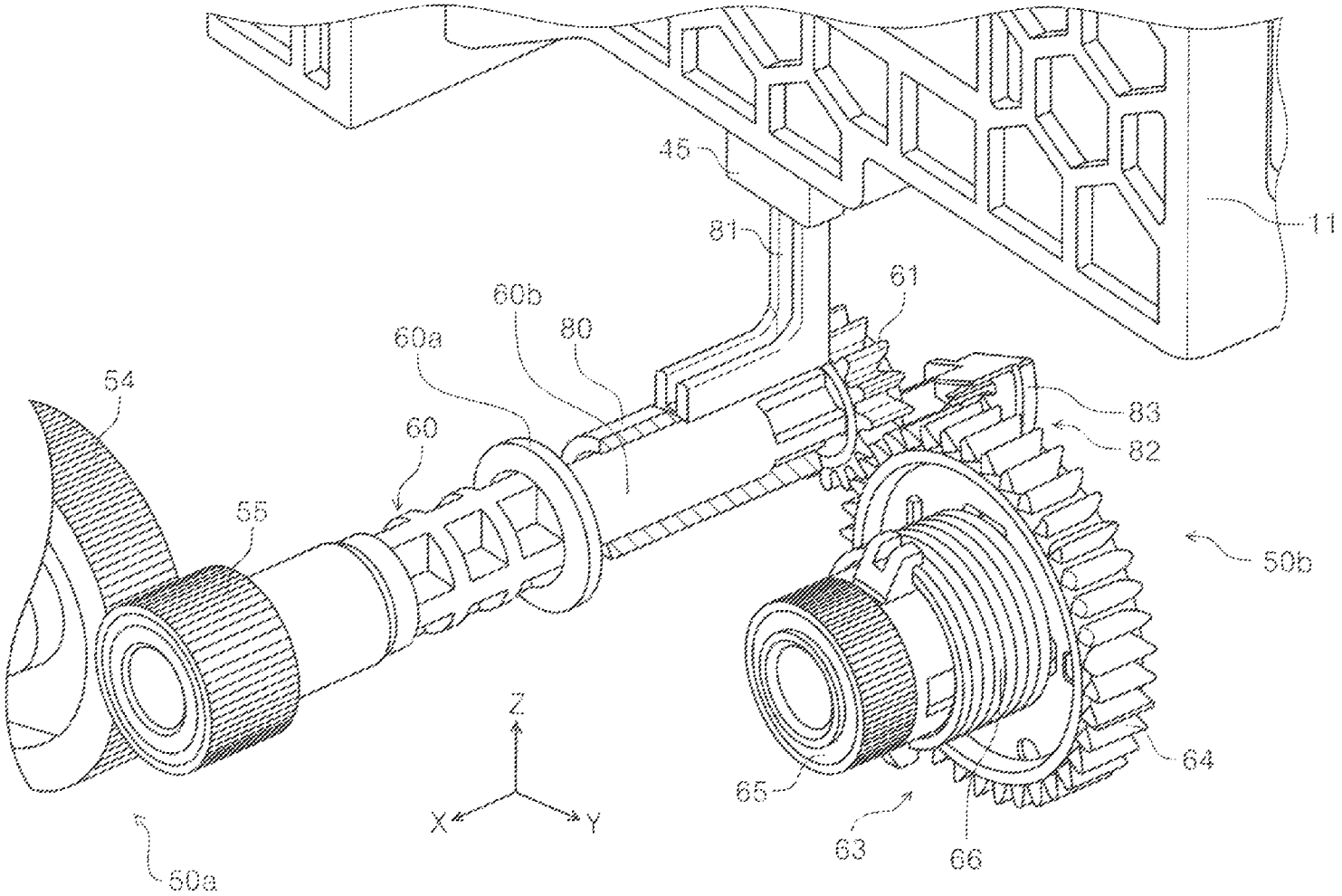
FIG. 5 is a perspective view of the main portion of the power transmission unit in a power transmission state.
Figure 6:
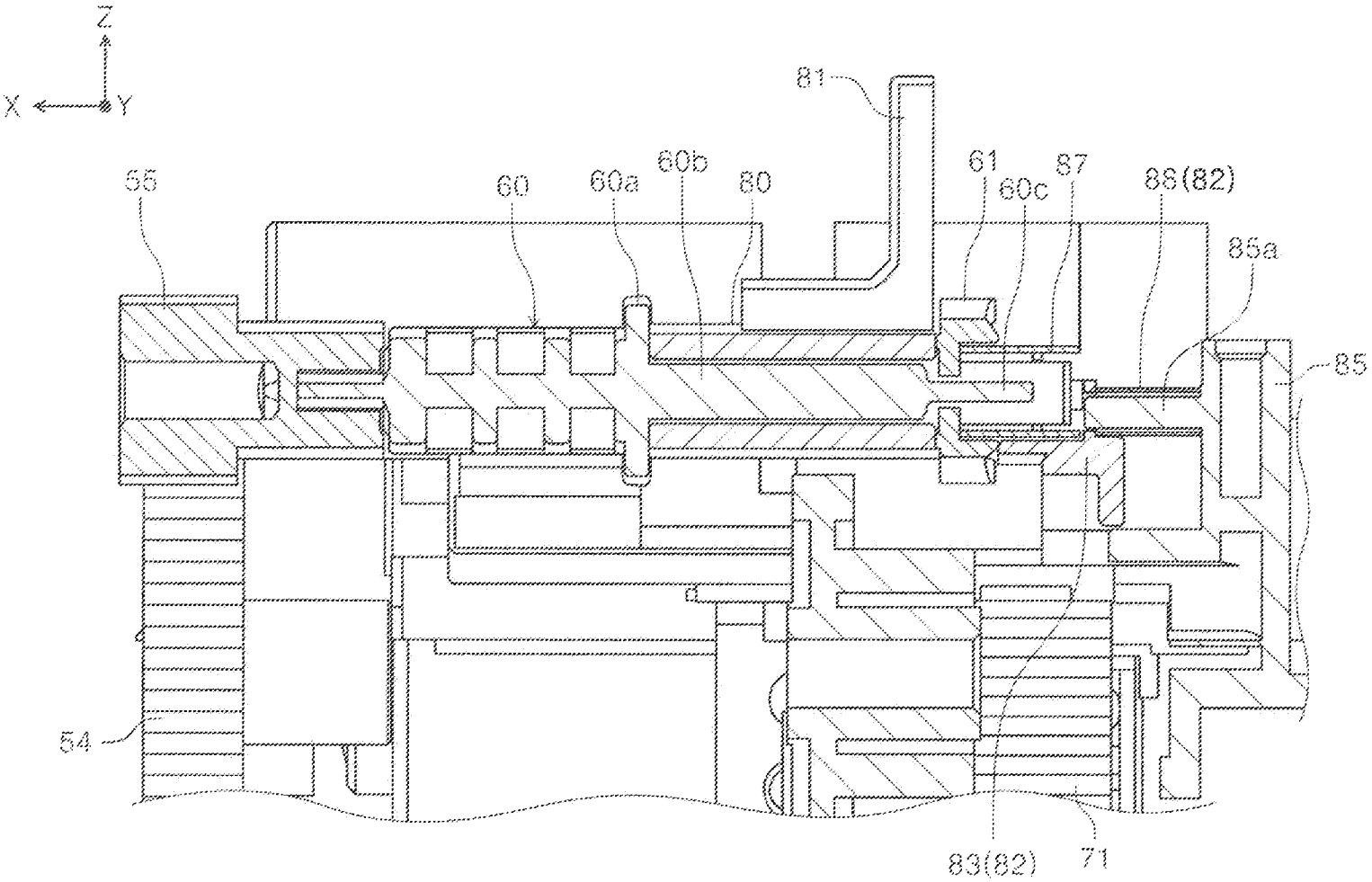
FIG. 6 is a cross-sectional view of the main portion of the power transmission unit in the power non-transmission state.
Figure 7:
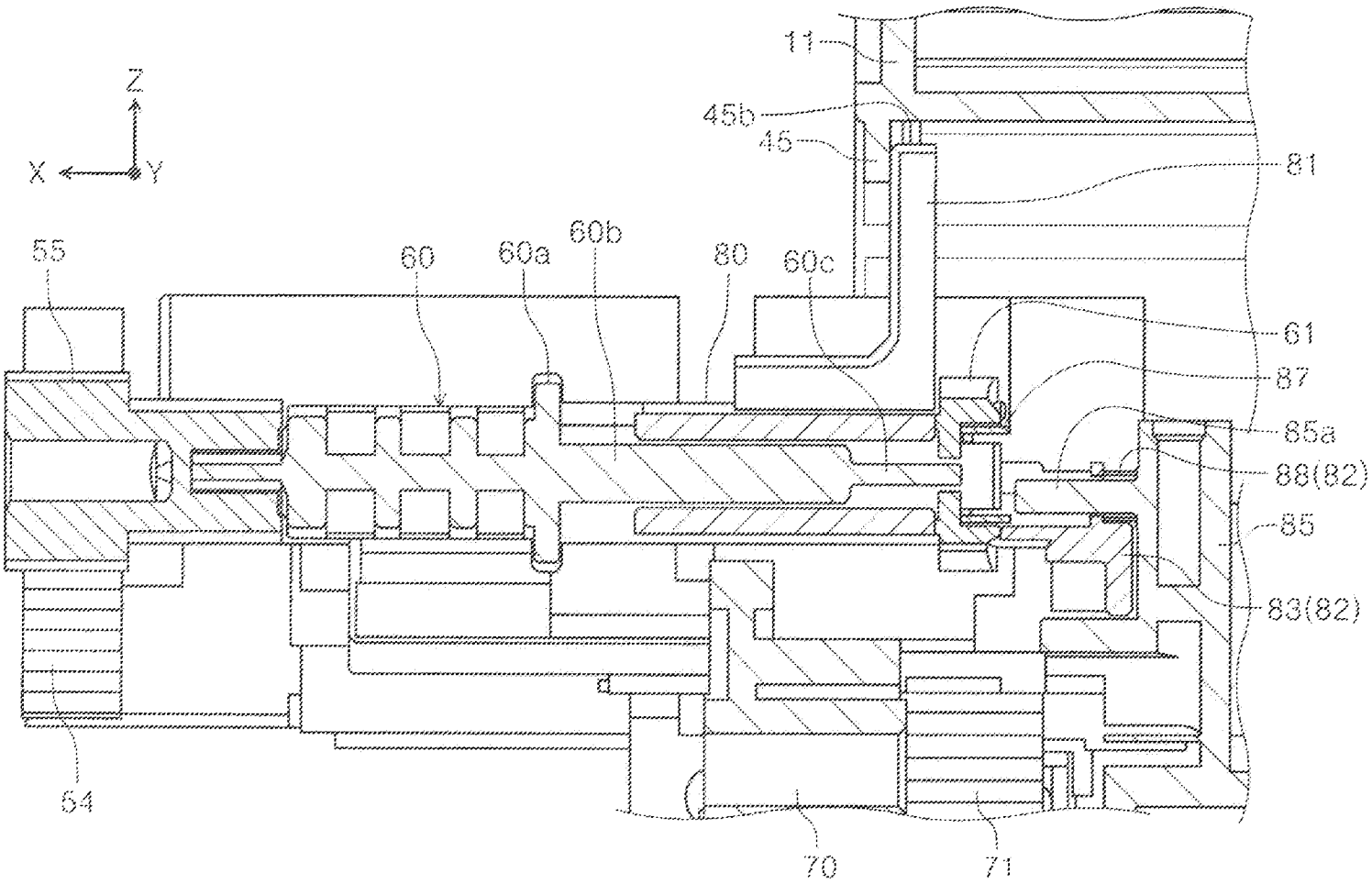
FIG. 7 is a cross-sectional view of the main portion of the power transmission unit in the power transmission state.

FIGS. 4 and 6 illustrate the power non-transmission state of the power transmission unit 50, and FIGS. 5 and 7 illustrate the power transmission state of the power transmission unit 50. Note that FIG. 5 illustrates a partial cross section of a slide member 80. Further, FIGS. 6 and 7 do not illustrate the first toothed gear 64 illustrated in FIGS. 4 and 5 due to a relationship of a cross-sectional position. Further, FIGS. 4 and 5 do not illustrate the toothed gear downstream of the toothed gear 65.

In FIGS. 4 to 7, the transmission shaft 60 is provided on the toothed gear 55 so as to rotate integrally with the toothed gear 55. A flange portion 60*a* is formed on the transmission shaft 60, a first shaft portion 60*b* is formed in the −X direction with respect to the flange portion 60*a*, and a second shaft portion 60*c* is further formed in the −X direction with respect to the first shaft portion 60*b*.

The slide member 80 having a cylindrical shape is inserted into the first shaft portion 60*b*, and the second toothed gear 61 is inserted into the second shaft portion 60*c*.

The slide member 80 is inserted so as to be rotatable relatively to the first shaft portion 60*b* and be slidable in the X-axis direction with respect to the first shaft portion 60*b*. A lever member 81 is integrally formed on the slide member 80.

The second toothed gear 61 stops rotating with respect to the second shaft portion 60*c* so as to be able to rotate integrally with the second shaft portion 60*c*, and is inserted so as to be slidable in the X-axis direction with respect to the second shaft portion 60*c*. The second toothed gear 61 is displaced into a meshing position in which the second toothed gear 61 meshes with the first toothed gear 64 by sliding in the X-axis direction, and a non-meshing position in which the second toothed gear 61 does not mesh with the first toothed gear 64, which will be described later in detail.

A first pressing spring 87 is provided as a first pressing member between the second toothed gear 61 and the frame 8, and the second toothed gear 61 is pressed in the +X direction by the first pressing spring 87. A pressing force of the first pressing spring 87 acts on the slide member 80 via the second toothed gear 61, that is, the second toothed gear 61 and the slide member 80 are in a state of being pressed in the +X direction. Note that the flange portion 60*a* is formed in the +X direction with respect to the slide member 80, and thus the slide member 80 is in a state of being pressed against the flange portion 60*a* by the pressing force of the first pressing spring 87. In this way, a frictional force is generated between the flange portion 60*a* and the slide member 80. Then, when the transmission shaft 60 rotates, rotational torque is transmitted to the slide member 80 and the second toothed gear 61.

Further, an movable member 83 is pressed against the second toothed gear 61 in the +X direction. The movable member 83 is inserted into a shaft portion 85*a* formed on the frame 85 and is slidable in the X-axis direction. The movable member 83 can be displaced into a contact position in which the movable member 83 is in contact with the first toothed gear 64 by sliding in the X-axis direction, and a separation position in which the movable member 83 is separated from the first toothed gear 64, which will be described later in detail.

A second pressing spring 88 is provided as a second pressing member between the movable member 83 and the frame 85, the movable member 83 is pressed in the +X direction by the second pressing spring 88, and the movable member 83 is pressed against the second toothed gear 61 in the +X direction.

Note that the movable member 83 is provided so as not to rotate about the shaft portion 85*a* by a rotation restriction portion (not illustrated) formed on the frame 85.

The movable member 83 and the second pressing spring 88 constitute the restriction unit 82. The restriction unit 82 will be described again after the state switching of the power transmission unit 50 is described.

In the power non-transmission state of the power transmission unit 50 illustrated in FIGS. 4 and 6, the second toothed gear 61 and the first toothed gear 64 are offset in the X-axis direction. Therefore, in the power non-transmission state, the first power transmission path 50*a* and the second power transmission path 50*b* are disconnected, and power of the transport motor 28 is not transmitted to the sheet receiving tray 17.

In contrast, in the power transmission state of the power transmission unit 50 illustrated in FIGS. 5 and 7, the second toothed gear 61 is displaced in the −X direction to a position in which the second toothed gear 61 meshes with the first toothed gear 64. Therefore, in the power transmission state, the first power transmission path 50*a* and the second power transmission path 50*b* are coupled, and power of the transport motor 28 is transmitted to the sheet receiving tray 17.

Next, the lever member 81 can be displaced, by rotation of the transport motor 28, into an advance state indicated by a solid line in FIG. 4 and a reference sign 81-1, and a retraction state indicated by a two-dot chain line and a reference sign 81-2. In the advance state of the lever member 81, the lever member 81 advances into the movement region Bc (see FIG. 1) of the carriage 11, and can be in contact with a lever contact portion 45 (see FIG. 8) formed on the carriage 11. In the retraction state of the lever member 81, the lever member 81 retracts from the movement region Bc (see FIG. 1) of the carriage 11, and is not contact with the lever contact portion 45 (see FIG. 8) formed on the carriage 11.

The lever member 81 switches from the retraction state to the advance state by reverse rotation of the transport motor 28, and switches from the advance state to the retraction state by normal rotation of the transport motor 28. A rotation limit of the lever member 81 when the transport motor 28 rotates in the normal direction and the reverse direction is restricted by a restricting portion (not illustrated) formed on the frame 85. When the transport motor 28 further rotates after the rotation of the lever member 81 is restricted, the transmission shaft 60 rotates while the lever member 81 stops rotating.

Hereinafter, control when the sheet receiving tray 17 is switched from the first state to the second state, that is, when the sheet receiving tray 17 protrudes in the +Y direction will be described with reference to FIG. 14 and other diagrams as appropriate.

In a printing stand-by state, the lever member 81 is in the retraction state. When the control unit 20 (see FIG. 2) receives recording data (Yes in step S101), the carriage 11 is moved in the +X direction (step S102), and a position of the lever contact portion 45 is located in the +X direction with respect to the lever member 81. The transport motor 28 is then rotated in the reverse direction (step S103) to switch the lever member 81 from the retraction state to the advance state.

In this way, the lever contact portion 45 of the carriage 11 can push the lever member 81 toward the −X direction.

The carriage 11 is then moved in the −X direction (step S104), and the lever contact portion 45 moves the lever member 81 in the −X direction. In this way, the second toothed gear 61 meshes with the first toothed gear 64, and the power transmission unit 50 is brought into the power transmission state. The state at this time is the state illustrated in FIG. 5.

Note that, when the carriage 11 is moved in the −X direction in step S104, there is a risk that a tooth of the second toothed gear 61 and a tooth of the first toothed gear 64 collide with each other and may not mesh with each other. In this case, a drive current value of the carriage motor 25 (see FIG. 2) exceeds a threshold value before the carriage 11 reaches a target position. Therefore, in this case, the control unit 20 (see FIG. 2) temporarily stops the carriage motor 25 and rotates the transport motor 28 by a predetermined amount. Note that the rotation of the transport motor 28 may be normal rotation, reverse rotation, or alternately normal rotation and reverse rotation. Further, it is preferable that the amount of the rotation is not equal to the amount of rotation corresponding to one tooth of the toothed gear. In this way, when a phase of the second toothed gear 61 changes and the carriage motor 25 is moved again, the second toothed gear 61 and the first toothed gear 64 can mesh with each other.

Figure 8:
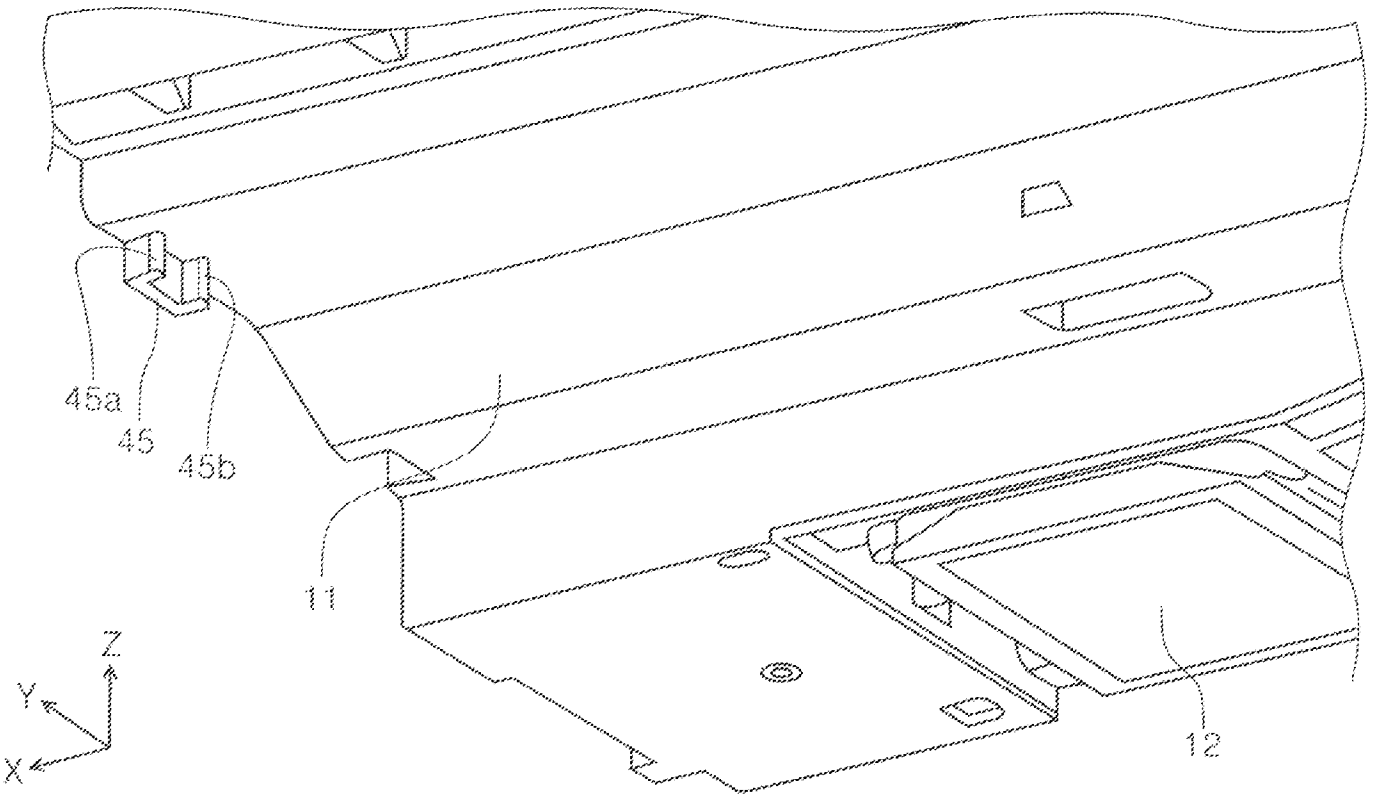
FIG. 8 is a perspective view of a lever contact portion provided on a carriage.

Note that, as illustrated in FIG. 8, a wall 45*a* is formed on the lever contact portion 45 in the +Y direction, and a wall 45*b* is formed on the lever contact portion 45 in the −Y direction. Then, when the lever member 81 comes into contact with the lever contact portion 45, the wall 45*a* is located in the +Y direction and the wall 45*b* is located in the −Y direction with respect to the lever member 81, that is, the lever member 81 is held in a state so as not to rotate in either direction. In this way, even when the transport motor 28 is rotated in either direction of the normal direction and the reverse direction, the transport motor 28 can be freely controlled without the lever member 81 being disengaged from the lever contact portion 45.

The power transmission unit 50 is brought into the power transmission state by performing step S104, and thus the transport motor 28 is then rotated in the normal direction to displace the sheet receiving tray 17 in the +Y direction and switch the sheet receiving tray 17 to the second state (step S105).

Subsequently, the carriage 11 is moved in the +X direction (step S106), and the lever contact portion 45 is separated from the lever member 81 in the +X direction. In this way, the second toothed gear 61, the slide member 80, and the lever member 81 move in the +X direction by a spring force of the first pressing spring 87, and particularly, the second toothed gear 61 is separated from the first toothed gear 64 and does not mesh with the first toothed gear 64. In this way, the first power transmission path 50*a* and the second power transmission path 50*b* are disconnected, and the power transmission unit 50 is brought into the power non-transmission state. The transport motor 28 is then rotated in the normal direction to switch the lever member 81 from the advance state to the retraction state (step S107).

Figure 15:
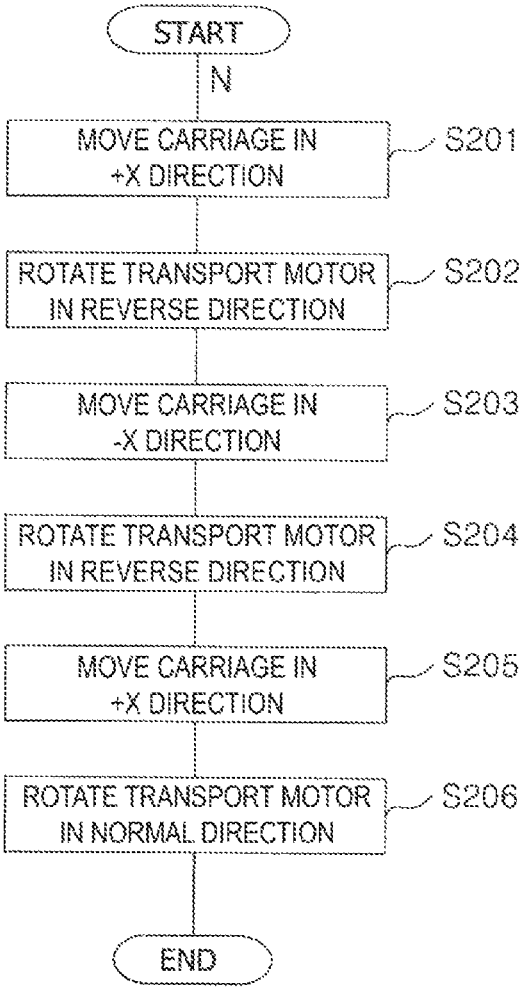
FIG. 15 is a flowchart illustrating control when the sheet receiving tray is switched from the second state to the first state.

Conversely, switching of the sheet receiving tray 17 from the second state to the first state, i.e., the movement in the −Y direction is performed in the step illustrated in FIG. 15. First, the carriage 11 is moved in the +X direction (step S201), and the lever contact portion 45 is located in the +X direction with respect to the lever member 81. The transport motor 28 is then rotated in the reverse direction (step S202) to switch the lever member 81 from the retraction state to the advance state.

The carriage 11 is then moved in the −X direction (step S203), and the lever contact portion 45 moves the lever member 81 in the −X direction. In this way, the second toothed gear 61 meshes with the first toothed gear 64, and the power transmission unit 50 switches to the power transmission state.

The transport motor 28 is then rotated in the reverse direction to displace the sheet receiving tray 17 in the −Y direction and switch the sheet receiving tray to the first state (step S204). Subsequently, the carriage 11 is moved in the +X direction (step S205), and the lever contact portion 45 is separated from the lever member 81 in the +X direction. In this way, the second toothed gear 61 is separated from the first toothed gear 64 and does not mesh with the first toothed gear 64, and the power transmission unit 50 is brought into the power non-transmission state. The transport motor 28 is then rotated in the normal direction to switch the lever member 81 from the advance state to the retraction state (step S206).

Next, the restriction unit 82 will be described. The movable member 83 constituting the restriction unit 82 is provided so as to be able to advance and retreat with respect to the first toothed gear 64. When the power transmission unit 50 is in the power non-transmission state in FIGS. 4 and 6, the movable member 83 constituting the restriction unit 82 advances into the first toothed gear 64 by a pressing force of the second pressing spring 88 and is in contact with the first toothed gear 64. This state is a restriction state of the restriction unit 82.

Figure 9:
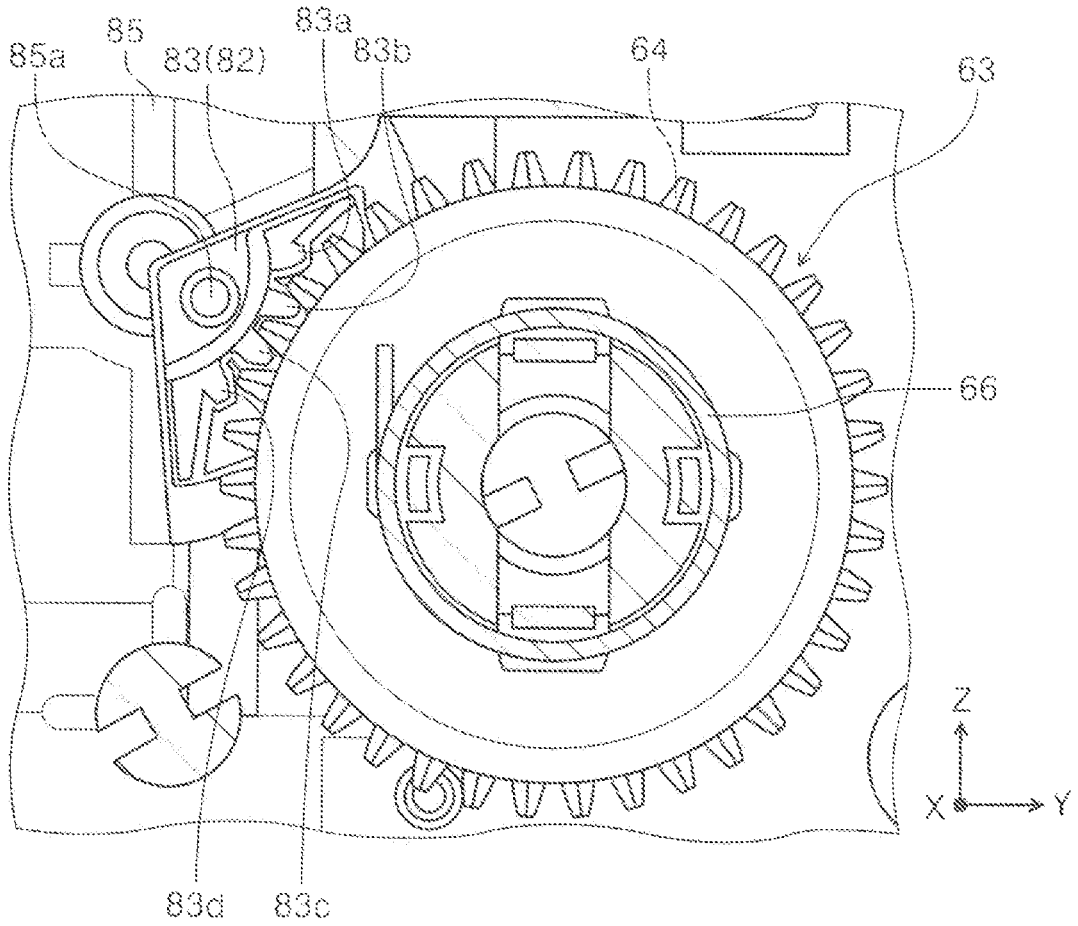
FIG. 9 is a front view of an movable member and a first toothed gear.

FIG. 9 is a front view of the movable member 83 and the first toothed gear 64 when the power transmission unit 50 is in the power non-transmission state in FIGS. 4 and 6. As illustrated in FIG. 9, tooth portions 83*a*, 83*b*, 83*c*, and 83*d* are formed on the movable member 83, and, in a state where the movable member 83 advances into the first toothed gear 64, each of the tooth portions mesh with the tooth of the first toothed gear 64.

Since the movable member 83 is provided such that the movable member 83 cannot rotate, the first toothed gear 64 cannot also rotate in a state where the movable member 83 advances into and comes into contact with the first toothed gear 64. Thus, displacement of the sheet receiving tray 17 is restricted, and unintended displacement of the sheet receiving tray 17 is suppressed.

Then, when the power transmission unit 50 switches to the power transmission state in FIGS. 5 and 7, the movable member 83 is pushed in the −X direction by the second toothed gear 61 and is separated from the first toothed gear 64. In other words, the restriction unit 82 is brought into a non-restriction state where displacement of the sheet receiving tray 17 is not restricted. Therefore, the sheet receiving tray 17 can be driven by the transport motor 28 without being affected by the restriction unit 82.

As described above, the printer 1 includes the power transmission unit 50 for switching between the power transmission state of transmitting power of the transport motor 28 from the transport motor 28 to the sheet receiving tray 17, and the power non-transmission state of not transmitting power of the transport motor 28 from the transport motor 28 to the sheet receiving tray 17, and the restriction unit 82 for switching between the restriction state of restricting displacement of the sheet receiving tray 17 when the power transmission unit 50 is in the power non-transmission state, and the non-restriction state of not performing the restriction when the power transmission unit 50 is in the power transmission state.

In this way, displacement of the sheet receiving tray 17 is restricted when the power transmission unit 50 is in the power non-transmission state, and a malfunction that the sheet receiving tray 17 unintentionally moves when the device is tilted and the like can be suppressed.

Then, in the power transmission state of the power transmission unit 50, the restriction unit 82 is in the non-restriction state where displacement of the sheet receiving tray 17 is not restricted, and thus the restriction unit 82 does not apply a load to the transport motor 28. In this way, the transport accuracy when the recording sheet is transported by rotating the transport roller pair 8 and the discharge roller pair 14 can be secured, and power consumption can also be suppressed.

Further, in the present exemplary embodiment, the power transmission unit 50 includes the first power transmission path 50*a*, and the second power transmission path 50*b* downstream of the first power transmission path 50*a* in the transmission direction of power from the transport motor 28 to the sheet receiving tray 17, and the power transmission unit 50 is brought into the power transmission state by coupling between the first power transmission path 50*a* and the second power transmission path 50*b*, and the power transmission unit 50 is brought into the power non-transmission state by disconnection between the first power transmission path 50*a* and the second power transmission path 50*b*.

Then, the restriction unit 82 includes the movable member 83 that can be displaced into the contact position (see FIG. 6) in which the movable member 83 is in contact with the first toothed gear 64 as the rotating body constituting the second power transmission path 50*b*, and the separation position (see FIG. 7) in which the movable member 83 is separated from the first toothed gear 64, and the restriction unit 82 is brought into the restriction state by the movable member 83 located in the contact position, and the restriction unit 82 is brought into the non-restriction state by the movable member 83 located in the separation position. In this way, the restriction unit 82 can be formed with a simple structure.

Further, the second power transmission path 50*b* includes the first toothed gear 64, and the first power transmission path 50*a* includes the second toothed gear 61. The second toothed gear 61 can be displaced into the meshing position (see FIGS. 5 and 7) in which the second toothed gear 61 meshes with the first toothed gear 64 to couple the first power transmission path 50*a* and the second power transmission path 50*b*, and the non-meshing position (see FIGS. 4 and 6) in which the second toothed gear 61 is separated from the first toothed gear 64 to disconnect the first power transmission path 50*a* and the second power transmission path 50*b*. Then, the movable member 83 is provided, by engaging with the second toothed gear 61, so as to advance and retreat with respect to the first toothed gear 64 in conjunction with displacement of the second toothed gear 61, the movable member 83 is located in the separation position (see FIG. 7) when the second toothed gear 61 is located in the meshing position, and the movable member 83 is located in the contact position (see FIG. 6) when the second toothed gear 61 is located in the non-meshing position.

In this manner, the movable member 83 is provided, by engaging with the second toothed gear 61, so as to advance and retreat with respect to the first toothed gear 64 in conjunction with displacement of the second toothed gear 61. Thus, a special power source for displacing the movable member 83 is unnecessary, and a cost of the device can be suppressed.

However, it goes without saying that the movable member 83 may be configured to be displaced by a driving unit such as a solenoid, for example.

Further, the movable member 83 includes the tooth portions 83*a*, 83*b*, 83*c*, and 83*d* (see FIG. 9) that mesh with the first toothed gear 64, and the restriction unit 82 is brought into the restriction state by the first toothed gear 64 and the tooth portions 83*a*, 83*b*, 83*c*, and 83*d* meshing with each other when the movable member 83 is located in the contact position in contact with the first toothed gear 64. In this way, displacement of the sheet receiving tray 17 can be reliably restricted.

However, instead of providing the tooth portions 83*a*, 83*b*, 83*c*, and 83*d*, for example, a high friction material such as rubber may be provided on a surface of the movable member 83 in contact with the first toothed gear 64, and rotation of the first toothed gear 64 may be restricted by a frictional force.

Further, the power transmission unit 50 includes the lever member 81 that can be displaced along the movement direction of the carriage 11, and can switch between the advance state of advancing into the movement region of the carriage 11 by rotation of the transport motor 28 and the retraction state of retracting from the movement region of the carriage 11. The lever member 81 is provided in a position adjacent to the second toothed gear 61, and the second toothed gear 61 and the movable member 83 are displaced by displacement of the lever member 81.

In this way, the second toothed gear 61 is subjected to external force from the carriage 11 via the lever member 81 in a position close to the carriage 11, and the second toothed gear 61 can be favorably displaced in response.

Further, the second toothed gear 61 and the lever member 81 are provided so as to be slidable with respect to the transmission shaft 60 serving as a shaft member that is a member different from the rotary shaft 15*a* of the discharge driving roller 15. Thus, a degree of freedom of arrangement of the second toothed gear 61 and the lever member 81 is improved.

Further, the second toothed gear 61, the lever member 81, and the movable member 83 are pressed in the +X direction as the second direction, and the carriage 11 pushes, in the −X direction as the first direction, the lever member 81 in the advance state, to displace the second toothed gear 61 from the non-meshing position to the meshing position and displace the movable member 83 from the contact position to the separation position.

Further, in a case in which the carriage 11 pushes, in the −X direction, the lever member 81 in the advance state to displace the second toothed gear 61 from the non-meshing position to the meshing position, the control unit 20 stops the carriage 11 when a drive load of the carriage 11, i.e., a drive load of the carriage motor 25 exceeds a threshold value, and the control unit 20 rotates the transport motor 28 by a predetermined amount and then moves the carriage 11 again in the −X direction. In this way, even when the first toothed gear 64 and the second toothed gear 61 do not mesh with each other, the first toothed gear 64 and the second toothed gear 61 can be expected to appropriately mesh with each other.

Further, the carriage 11 includes the lever contact portion 45 that comes into contact with the lever member 81, and the lever contact portion 45 includes the wall that maintains the state where the lever member 81 is in contact with the lever contact portion 45 regardless of rotation of the transport motor 28.

According to the present aspect, the state where the lever member 81 is in contact with the lever contact portion 45 is maintained regardless of a rotation direction of the transport motor 28. Thus, when the power transmission unit 50 is in the power transmission state, the sheet receiving tray 17 can be freely driven in a direction from the first state toward the second state and a reverse direction thereof.

Further, the power transmission unit 50 includes the first pressing spring 87 that presses the second toothed gear 61 toward the non-meshing position, and the restriction unit 82 includes the second pressing spring 88 that is a member different from the first pressing spring 87 and presses the movable member 83 toward the contact position. In this way, both of a pressing force for pressing the second toothed gear 61 and a pressing force for pressing the movable member 83 can be set to appropriate magnitude.

Next, another exemplary embodiment will be described with reference to FIGS. 10 to 13.

The exemplary embodiment described below is different from the exemplary embodiment described above in points that a stopper 85*d* is provided near a lever member 81, and the wall 45*b* (see FIG. 8) is not provided on a lever contact portion provided on a carriage 11.

Figure 10:
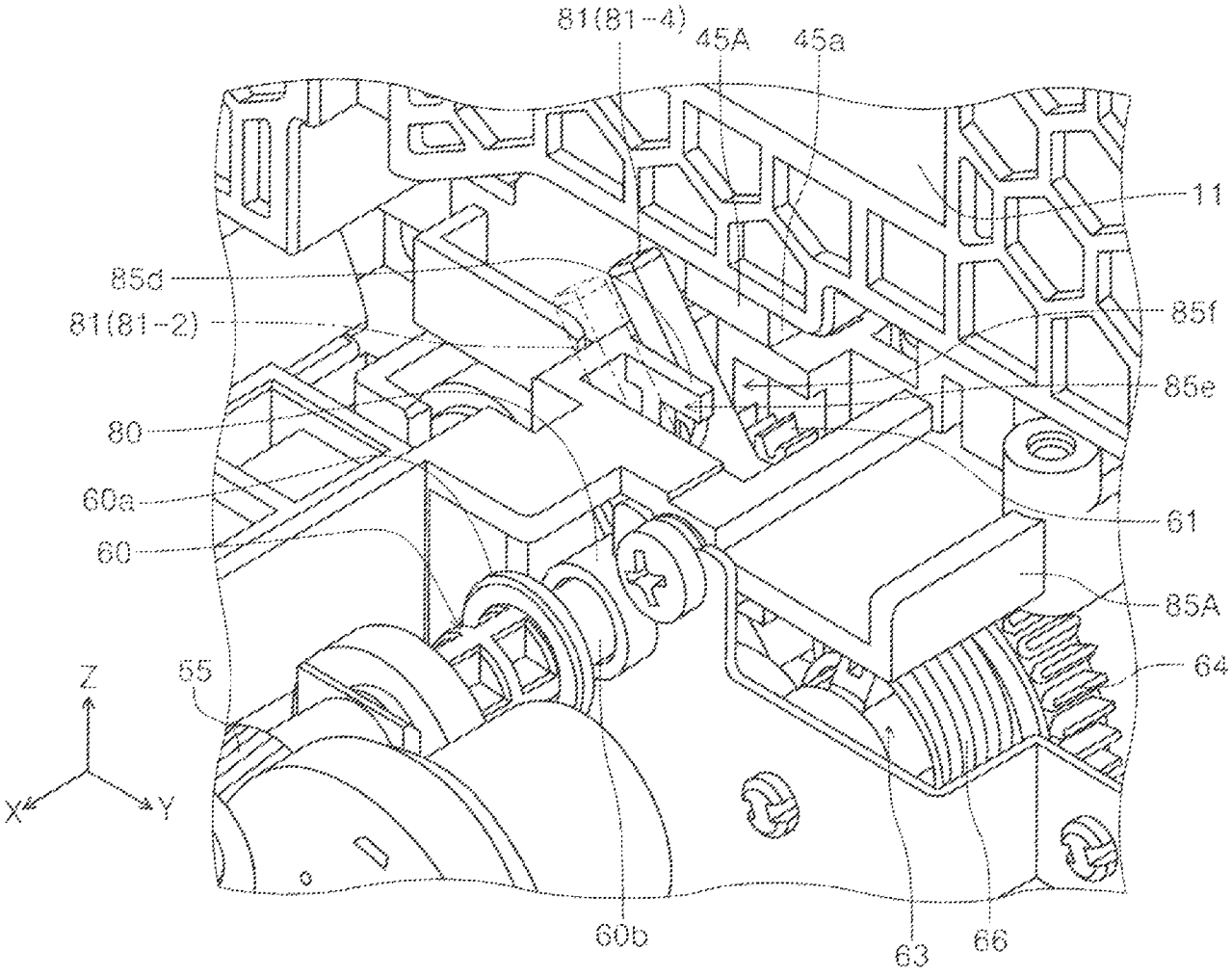
FIG. 10 is a perspective view illustrating a main portion of a frame according to another exemplary embodiment.
Figure 11:
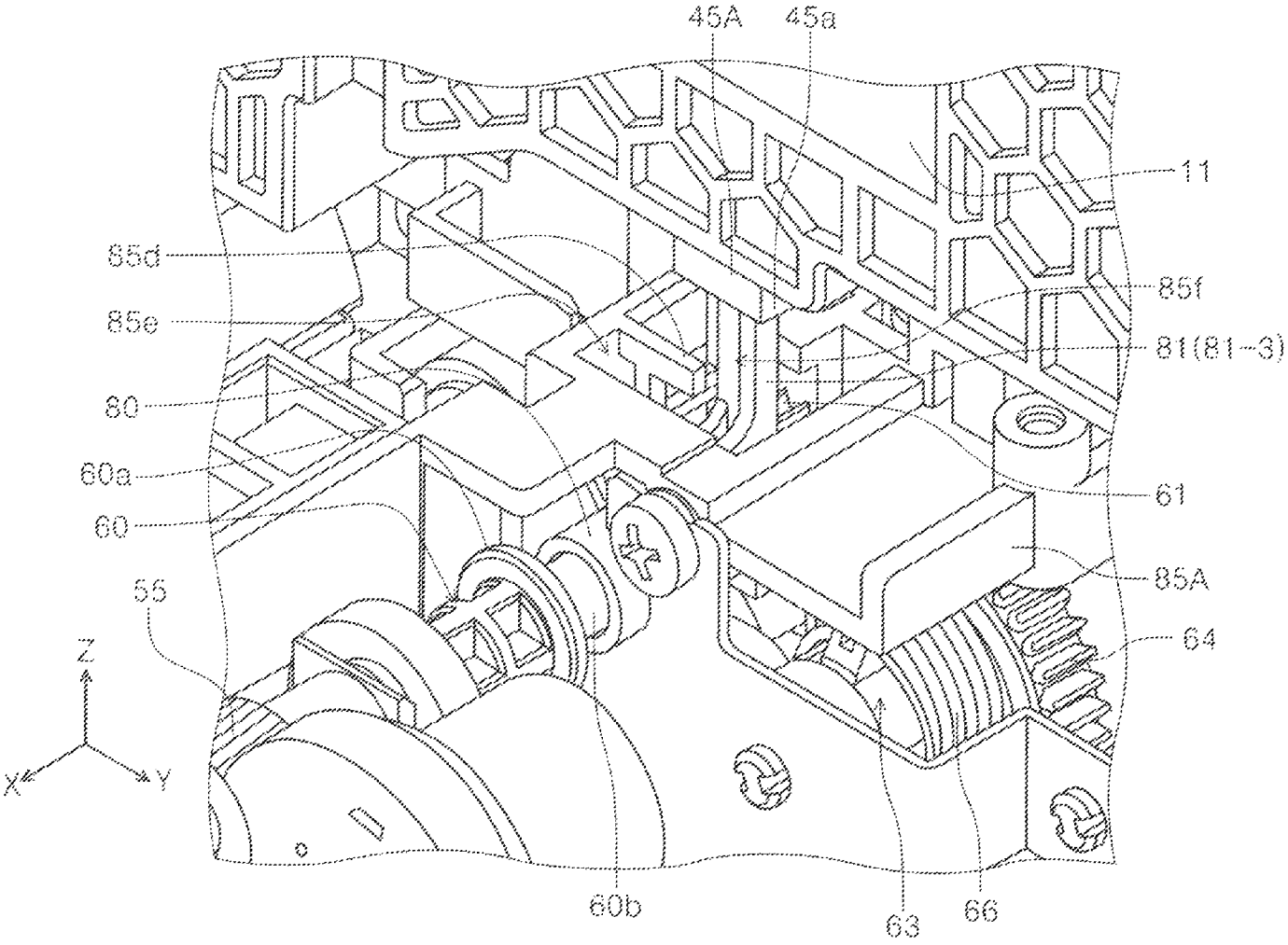
FIG. 11 is a perspective view illustrating a main portion of a frame according to the other exemplary embodiment.

In FIGS. 10 and 11, the stopper 85*d* is provided on a frame 85A, a first holding portion 85*e* in which the lever member 81 enters and is held in the +X direction with respect to the stopper 85*d* is formed, and a second holding portion 85*f* in which the lever member 81 enters and is held in the −X direction with respect to the stopper 85*d* is formed.

The lever member 81 indicated by a two-dot chain line and a reference sign 81-2 is in a retraction state, and a situation where the lever member 81 is held by the first holding portion 85*e* is illustrated. In this state, a second toothed gear 61 is separated from a first toothed gear 64, and a power transmission unit 50 is in a power non-transmission state.

Further, the lever member 81 indicated by a solid line and a reference sign 81-4 is in a retraction state, and a situation where the lever member 81 is held by the second holding portion 85*f* is illustrated. In this state, the second toothed gear 61 meshes with the first toothed gear 64, and the power transmission unit 50 is in a power transmission state.

In order to switch the lever member 81 from the state indicated by the two-dot chain line and the reference sign 81-2 to the state indicated by the solid line and the reference sign 81-4, a transport motor 28 is rotated in the reverse direction in a state where a lever contact portion 45A of the carriage 11 is located in the +X direction with respect to the lever member 81. In this way, the lever member 81 is switched from the retraction state to the advance state, and thus the carriage 11 is moved in the −X direction. This results in a state illustrated in FIG. 11.

Figure 12:
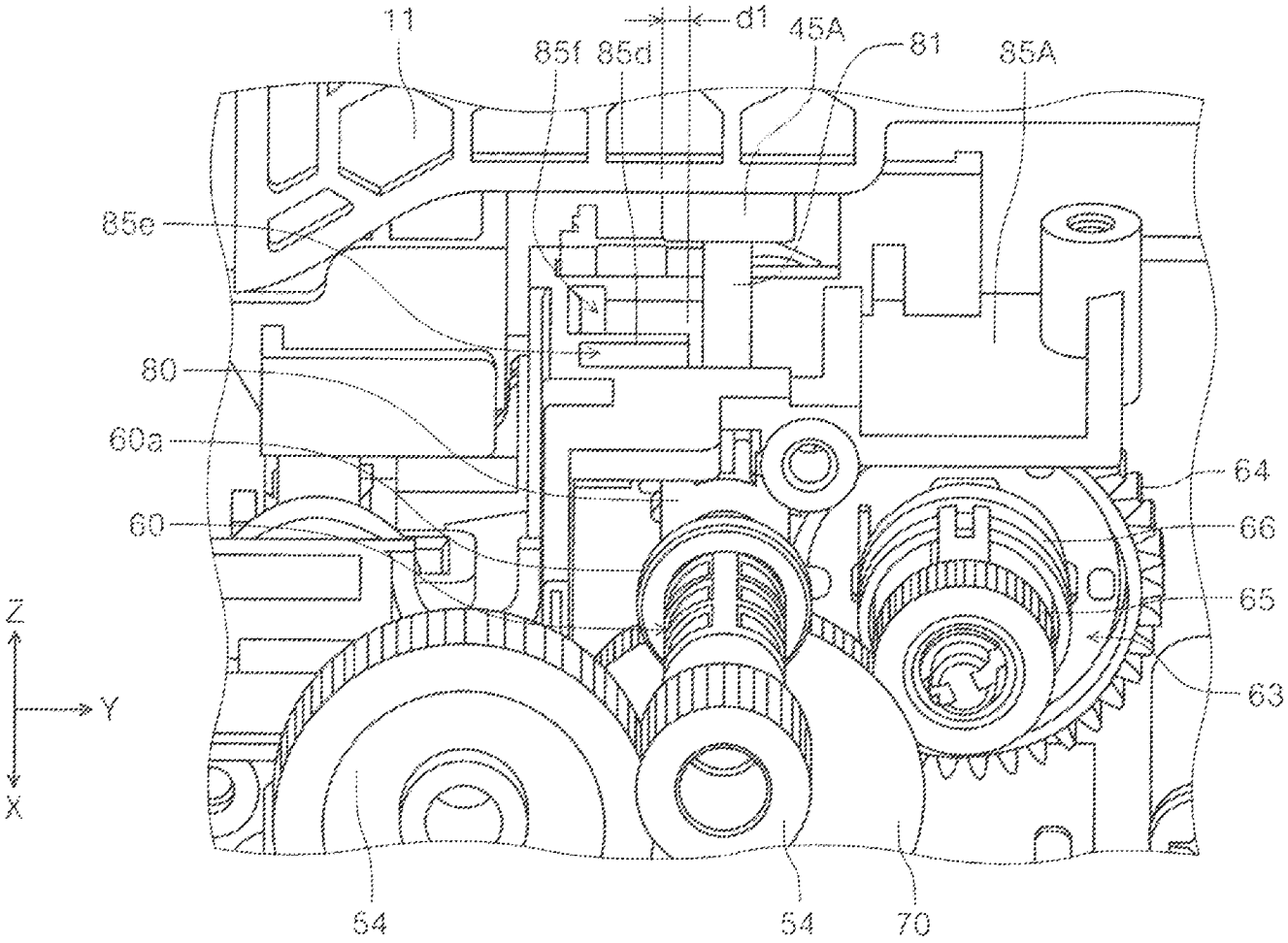
FIG. 12 is a perspective view illustrating a relationship between a lever contact portion provided on a carriage and a stopper.
Figure 13:
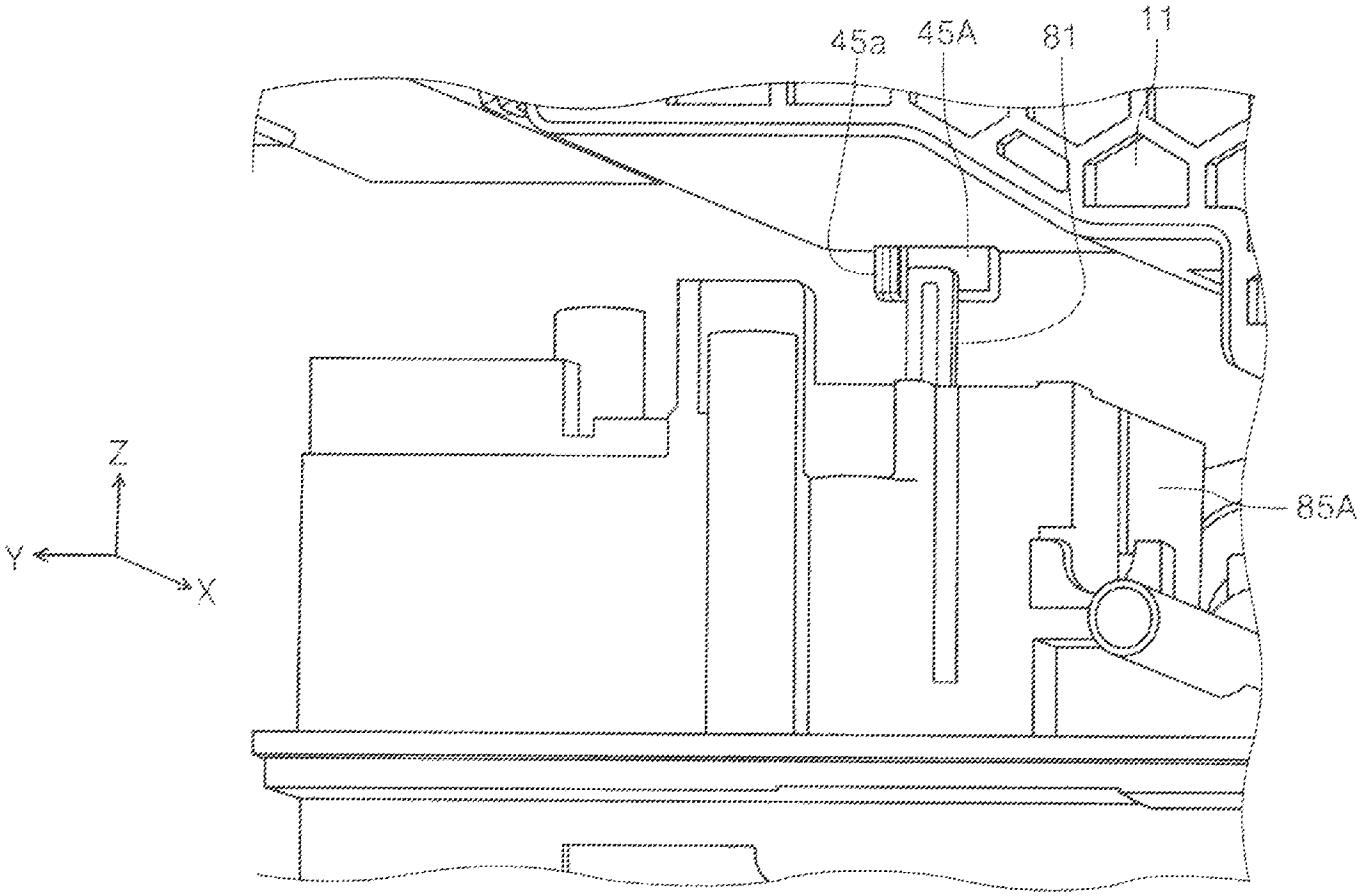
FIG. 13 is a perspective view of the lever contact portion provided on the carriage.

Here, as illustrated in FIG. 13, a wall portion 45*a* is formed in the +Y direction on the lever contact portion 45A included in the carriage 11, but a wall portion is not formed in the −Y direction. Then, as illustrated by a range dl in FIG. 12, the stopper 85*d* and the lever contact portion 45A overlap each other in the Y-axis direction. In this way, when the transport motor 28 is rotated in the normal direction from the state illustrated in FIG. 11, the lever member 81 can smoothly enter the second holding portion 85*f* without being caught on the stopper 85*d*. Note that, when the transport motor 28 is rotated in the reverse direction from the state illustrated in FIG. 11, the lever member 81 comes into contact with the wall portion 45*a* (see FIG. 13) formed on the lever contact portion 45A, and thus the lever member 81 is not disengaged from the lever contact portion 45A.

When the lever member 81 is in the state indicated by the solid line and the reference sign 81-4 in FIG. 12, a pressing force of a first pressing spring 87 (see FIG. 7) acts on the second toothed gear 61 in the +X direction, but the movement of the lever member 81 in the +X direction is restricted by the stopper 85*d*. In this way, the second toothed gear 61 can be maintained in the state of meshing with the first toothed gear 64. In other words, even when the carriage 11 is separated from the lever member 81, the power transmission unit 50 can be maintained in the power transmission state. Further, in this way, an movable member 83 can also be maintained in a separated position separated from the first toothed gear 64.

In this manner, the stopper 85*d* is provided that stops displacement, in the +X direction, of the lever member 81 in the retraction state when the second toothed gear 61 is located in the meshing position in which the second toothed gear 61 meshes with the first toothed gear 64 and the movable member 83 is also located in the separation position. Therefore, even when the carriage 11 is separated from the lever member 81, the second toothed gear 61 can be prevented from returning to the non-meshing position, and the movable member 83 can be prevented from returning to the contact position. In other words, even when the carriage 11 is separated from the lever member 81, the power transmission unit 50 can maintain the power transmission state. Thus, a degree of freedom of control of the carriage 11 is improved.

Figure 14:
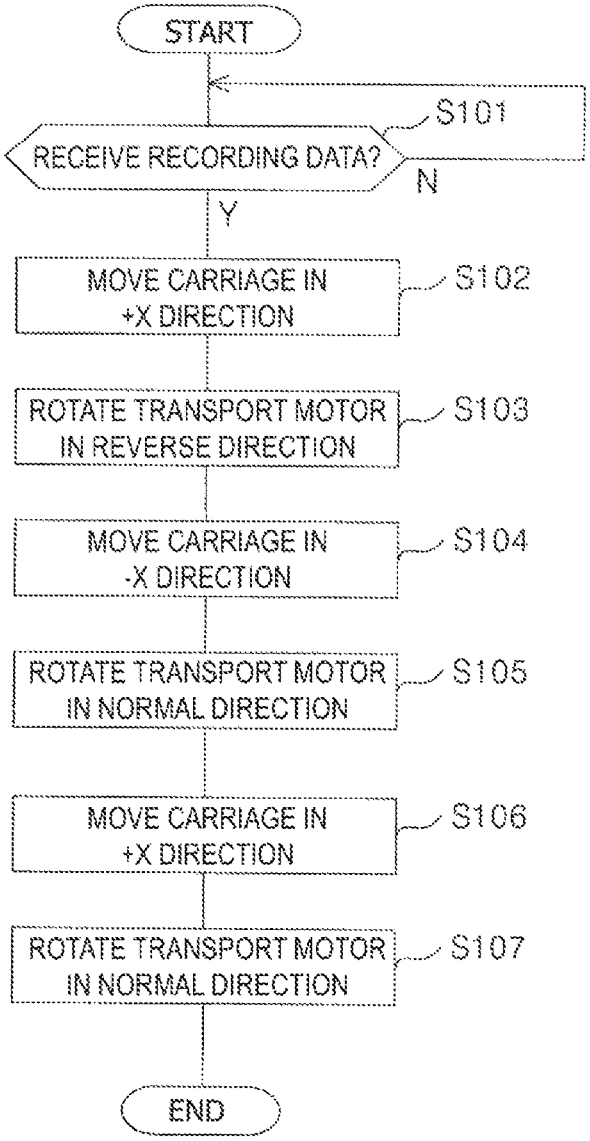
FIG. 14 is a flowchart illustrating control when a sheet receiving tray is switched from a first state to a second state.

For example, an operation of displacing the sheet receiving tray 17 in the +Y direction by step S105 in FIG. 14 and an operation of moving the carriage 11 can be performed simultaneously. Examples of the operation of the carriage 11 in this case include an operation of moving the recording head 12 to a maintenance unit that is located at the end portion in the −X direction, for example, and performs maintenance on the recording head 12, and performing maintenance on the recording head 12. The maintenance of the recording head 12 includes a flushing operation of wiping a head surface and discharging ink.

Alternatively, examples of an operation performed simultaneously with the operation of displacing the sheet receiving tray 17 in the +Y direction include an operation of detecting an edge of a recording sheet by the second sheet detection unit 31 (see FIG. 2) provided on the carriage 11. In other words, an operation of feeding a recording sheet can be performed simultaneously with the operation of displacing the sheet receiving tray 17 in the +Y direction.

Further, the present disclosure is not intended to be limited to each of the exemplary examples described above, and many variations are possible within the scope of the present disclosure as described in the appended claims. It goes without saying that such variations also fall within the scope of the present disclosure.

What is claimed is:

1. A recording device, comprising:

a recording unit that is configured to perform recording on a medium;

a discharge roller that is configured to discharge the medium on which recording was performed by the recording unit;

a medium receiving tray that is configured to receive the medium discharged by the discharge roller and switch between a first state and a second state in which the medium receiving tray is displaced in a discharge direction of the medium with respect to the first state;

a motor that serves as a power source of the discharge roller and the medium receiving tray;

a power transmission unit that is configured to switch between a power transmission state in which power of the motor is transmitted from the motor to the medium receiving tray, and a power non-transmission state in which the power of the motor is not transmitted from the motor to the medium receiving tray; and a restriction unit that is configured to switch between a restriction state in which the restriction unit restricts displacement of the medium receiving tray when the power transmission unit is in the power non-transmission state, and a non-restriction state in which the restriction unit does not restrict the displacement of the medium receiving tray when the power transmission unit is in the power transmission state, wherein the power transmission unit includes a first power transmission path that is coupled to the motor, and a second power transmission path that is provided at a downstream of the first power transmission path in a transmission direction of power from the motor to the medium receiving tray, the first power transmission path is coupled to the second power transmission path, when the power transmission unit is in the power transmission state, and the first power transmission path is uncoupled from the second power transmission path when the power transmission unit is in the power non-transmission state, the restriction unit includes a movable member that is configured to be displaced into a contact position in which the movable member is in contact with a rotating body that is provided on the second power transmission path, and a separation position in which the movable member is separated from the rotating body, and the movable member is located in the contact position when the restriction unit is in the restriction state, and the movable member is located in the separation position when the restriction unit is in the non-restriction state.

2. The recording device according to claim 1, wherein the rotating body is formed of a first toothed gear, a second toothed gear is provided on the first power transmission path, the second toothed gear is configured to be displaced into a meshing position in which the second toothed gear meshes with the first toothed gear to couple the first power transmission path and the second power transmission path, and a non-meshing position in which the second toothed gear is separated from the first toothed gear to be uncouple from the first power transmission path and the second power transmission path, the movable member is configured to advance and retreat with respect to the first toothed gear in conjunction with displacement of the second toothed gear, and the movable member is located in the separation position when the second toothed gear is located in the meshing position, and the movable member is located in the contact position when the second toothed gear is located in the non-meshing position.

3. The recording device according to claim 2, wherein the movable member includes a tooth portion that is configured to mesh with the first toothed gear in the contact position.

4. The recording device according to claim 2, further comprising:

a carriage that is provided with the recording unit and is configured to move along a movement axis intersecting a transport direction in which the medium is transported, wherein the power transmission unit includes a lever member that is configured to be displaced along a direction along the movement axis and switch, by rotation of the motor, between an advance state in which the lever advances into a movement region of the carriage and a retraction state in which the lever retracts from the movement region of the carriage, and the second toothed gear and the movable member are displaced when the lever member is displaced in the direction.

5. The recording device according to claim 4, wherein the second toothed gear and the lever member are provided on a shaft member that is a different member from a rotary shaft of the discharge roller, and are provided so as to be slidable with respect to the shaft member.

6. The recording device according to claim 4, wherein one direction along the movement axis of the carriage is a first direction, and the other direction along the movement axis of the carriage is a second direction, the second toothed gear, the lever member, and the movable member are pressed toward the second direction, and when the carriage pushes, in the first direction, the lever member, the second toothed gear is displaced from the non-meshing position to the meshing position and the movable member is displaced from the contact position to the separation position.

7. The recording device according to claim 6, further comprising a control unit that is configured to control a drive source of the carriage and the motor, wherein, in a case in which the carriage pushes, in the first direction, the lever member, the second toothed gear is displaced from the non-meshing position toward the meshing position and a drive load of the carriage exceeds a threshold value, the control unit stops the carriage, rotates the motor by a predetermined amount, and then moves the carriage again in the first direction.

8. The recording device according to claim 6, wherein the carriage includes a lever contact portion that is configured to come into contact with the lever member, and the lever contact portion includes a wall that is configured to maintain a state where the lever member is in contact with the lever contact portion.

9. The recording device according to claim 6, wherein the power transmission unit includes a first pressing member that is configured to press the second toothed gear toward the non-meshing position, and the restriction unit includes a second pressing member that is configured to press the movable member toward the contact position.

10. The recording device according to claim 6, further comprising:

a stopper that is configured to restrict displacement, in the second direction, of the lever member in the retraction state when the second toothed gear is located in the meshing position and the movable member is located in the separation position.

* * * * *